US011428038B2

(12) United States Patent
Skotty et al.

(10) Patent No.: US 11,428,038 B2
(45) Date of Patent: Aug. 30, 2022

(54) MOVABLE BARRIER OPERATOR

(71) Applicant: The Chamberlain Group LLC, Oak Brook, IL (US)

(72) Inventors: Brian Roy Skotty, Elmhurst, IL (US); Alberto Urias Vazquez, Sonora (MX); Jon James Parrinello, Elgin, IL (US)

(73) Assignee: The Chamberlain Group LLC, Oak Brook, IL (US)

( * ) Notice: Subject to any disclaimer, the term of this patent is extended or adjusted under 35 U.S.C. 154(b) by 456 days.

(21) Appl. No.: 16/616,882

(22) PCT Filed: Apr. 18, 2018

(86) PCT No.: PCT/US2018/028094
§ 371 (c)(1),
(2) Date: Nov. 25, 2019

(87) PCT Pub. No.: WO2018/217332
PCT Pub. Date: Nov. 29, 2018

(65) Prior Publication Data

US 2021/0032921 A1 Feb. 4, 2021

Related U.S. Application Data

(60) Provisional application No. 62/511,930, filed on May 26, 2017.

(51) Int. Cl.
*E05F 15/684* (2015.01)

(52) U.S. Cl.
CPC ..... *E05F 15/684* (2015.01); *E05Y 2201/66* (2013.01); *E05Y 2900/106* (2013.01)

(58) Field of Classification Search
CPC .. E05F 15/681; E05F 15/684; E05Y 2201/66; E05Y 2900/106
See application file for complete search history.

(56) References Cited

U.S. PATENT DOCUMENTS 4,520,591 A 6/1985 Calvagno
5,010,688 A 4/1991 Dombrowski et al.
(Continued)

FOREIGN PATENT DOCUMENTS

WO 02099235 12/2002

OTHER PUBLICATIONS

PCT/US2019/049265; International Search Report dated Jan. 23, 2020; 5 pages.

(Continued)

*Primary Examiner* — Quan Zhen Wang
*Assistant Examiner* — Rajsheed O Black-Childress
(74) *Attorney, Agent, or Firm* — Fitch, Even, Tabin & Flannery LLP

(57) ABSTRACT

In accordance with one aspect of the present disclosure, a head unit of a movable barrier operator is provided including a motor for moving a movable barrier and a first circuit board operable to provide power to the motor. The head unit includes a fire-resistant container that contains the first circuit board. This permits the electrical components of the head unit that utilize higher voltage, such as 120 volts, to be provided on the first circuit board and contained in the fire-resistant container. The head unit further includes a second circuit board outside of the fire-resistant container and operably coupled to the first circuit board. Because the second circuit board is outside of the fire-resistant container, the second circuit board may contain electrical components of the head unit that operate at lower voltages, such as at or below 24 volts.

15 Claims, 33 Drawing Sheets

(56) References Cited

U.S. PATENT DOCUMENTS

| | | | | |
|---|---|---|---|---|
| 5,557,887 | A | 9/1996 | Fellows | |
| 5,927,690 | A | 7/1999 | White et al. | |
| 2005/0156546 | A1 | 7/2005 | Keller | |
| 2009/0256440 | A1 | 10/2009 | Kragh | |
| 2014/0223825 | A1* | 8/2014 | Murray | E05F 15/79 49/31 |
| 2015/0151664 | A1 | 6/2015 | Chang | |
| 2022/0056751 | A1 | 2/2022 | Mastros | |

OTHER PUBLICATIONS

PCT/US2019/049265; Written Opinion of the International Searching Authority dated Jan. 23, 2020; 6 pages.
The Chamberlain Group, Liftmaster Chain Drive Garage Door Opener, Model 8360, copyright 2011, 40 pages.
The Chamberlain Group, Liftmaster Premium Series Belt Drive Garage Door Opener, Model 8355, copyright 2012, 76 pages.
PCT Patent Application No. PCT/US2018/028094; International Search Report and Written Opinion dated Dec. 27, 2018; 14 Pages.
U.S. Appl. No. 17/275,098, filed Mar. 10, 2021; Brian Phillip Mastros, et al.; 105 pages.

* cited by examiner

MOVABLE BARRIER OPERATOR

CROSS-REFERENCE TO RELATED APPLICATION

This application is a national phase application of PCT Application Number PCT/US2018/28094, filed Apr. 18, 2018, which claims the benefit of U.S. Provisional Patent App. No. 62/511,930, filed May 26, 2017, which are all incorporated by reference herein in their entireties.

FIELD

This disclosure relates to movable barriers and, more particularly, to movable barrier operators for moving movable barriers.

BACKGROUND

Various types of movable barrier operators are known for controlling the position of movable barriers. For example, movable barrier operators may include swinging gate operators, jackshaft operators, and others. One type of movable barrier operator utilizes a head unit to move a trolley along a rail. The trolley is in turn connected to a segmented door to translate movement of the trolley into movement of the segmented door. These types of operators are commonly located in a garage of a household to move a garage door between open and closed positions. One shortcoming with the head units of some of these garage door operators is that performing maintenance on the head unit of the garage door operator involves one or more tools that may complicate the procedure. For example, to troubleshoot the head unit, a user may need to remove a housing of the head unit which requires using a screwdriver or wrench to remove a fastener keeping the housing in position. One reason for requiring a tool to remove the housing is that these head units contain circuitry that utilizes high voltage, such as 120 volts. In order for the head unit to be underwriters laboratories (UL) certified, the circuitry utilizing the high voltage must be protected by an enclosure that requires a tool to open the enclosure. The requirement to use a tool to open the head unit may slow installation and/or maintenance of the head unit.

Another shortcoming with some prior garage door operator head units is that the control circuitry of the head unit is provided on one large circuit board within the housing of the head unit. If one components of the control circuitry fails, such as a Wi-Fi® chip, the user may be unable to remedy the broken component of the circuit board. The user may decide to simply replace the entire circuit board rather which may be unnecessary given that only one component of the circuit board requires replacement.

Some garage door operator systems include a head unit, a rail, a trolley movable along the rail and connected to a garage door, and a chain connecting the head unit to the trolley. The head unit includes a motor that turns a gear engaged with the chain to cause movement of the trolley and associated movement of the garage door. Other types of garage door operator systems include a head unit connected to a trolley by a belt. These head units have a drive pulley engaged with the belt and a motor for turning the drive pulley and causing movement of the belt and trolley connected thereto. The drive pulley and belt have teeth that intermesh to permit the pulley to grip the belt. When the drive pulley reverses direction and the belt is subject to high tension, such as a sudden reversal of direction of the garage door, the belt may slip relative to the pulley. This reduces the control the head unit has over the position of the garage door.

Movable barrier operator systems may be transported and sold in boxes. For example, one prior garage door operator system is sold in a box containing a head unit, rail sections, a trolley, and hardware for installing the garage door operator. During packaging of the garage door operator system, the rail sections are bundled together and positioned in the bottom of the box. Foam and cardboard inserts, the head unit, the trolley, and the hardware are then inserted into the box. The foam and cardboard inserts support the components of the system and provide rigidity to the box. One downside to this approach is that the foam and cardboard inserts may not be sufficiently strong to provide sufficient rigidity to the box so that the box may support several boxes of other garage door operator systems, such as when the systems are transported on a pallet. Further, the foam and cardboard inserts may not be sufficiently strong to withstand dropping or other damage that may occurring during transport of the system. Although more plastic or cardboard may be used to make the inserts more robust, the inserts may be discarded by the end user or installer such that the additional plastic or cardboard is landfilled or recycled.

SUMMARY

In accordance with one aspect of the present disclosure, a head unit of a movable barrier operator is provided including a motor for moving a movable barrier and a first circuit board operable to provide power to the motor. The head unit includes a fire-resistant container that contains the first circuit board. This permits the electrical components of the head unit that utilize higher voltage, such as 120 volts, to be provided on the first circuit board and contained in the fire-resistant container. Other higher voltages that may be used include 100 volts, 240 volts, 480 volts, and 560 volts. The head unit further includes a second circuit board outside of the fire-resistant container and operably coupled to the first circuit board. Because the second circuit board is outside of the fire-resistant container, the second circuit board may contain electrical components of the head unit that operate at lower voltages, such as at or below 24 volts. In this manner, the head unit may satisfy UL requirements for the high voltage components while the lower voltage components are outside the fire-resistant container and may be readily accessed by a user such as during installation or maintenance. Another advantage of the head unit is that the head unit may include a housing that may be removed by a user without requiring a tool because the high voltage components of the first circuit board are inside of the fire-resistant container. In other words, the housing of the head unit is not the primary fire-resistant vault for the high voltage components. Rather, the fire-resistant container operates as the fire-resistant vault for the high voltage components.

The second circuit board may contain circuitry to perform logic, radio, and micro processing operability. In one form, the second circuit board includes at least one wireless communication interface outside of the fire-resistant container. Because the second circuit board and the at least one wireless communication interface thereof are outside the fire-resistant container, the interference caused by the fire-resistant container may be reduced relative to if the at least one wireless interface was within the fire-resistant container. This may increase the range and accuracy of wireless transmissions from the at least one wireless communication interface. In another form, the second circuit board includes a microprocessor operable to control operation of the motor and the second circuit board is communicably coupled to an encoder of the motor via a communication link outside the fire-resistant container. In this manner, the motor communication link and the second circuit board may be accessed without having to open the fire-resistant container.

In accordance with another aspect, a head unit of a movable barrier operator is provided that includes a body, control circuitry supported by the body, and a battery station connected to the body that is adapted to receive a battery and provide power to the control circuitry. A battery cover is movable between a closed position that restricts removal of the battery from the battery station and an open position that permits removal of the battery from the battery station. The head unit further includes remote circuitry of the battery cover operably connected to the control circuitry and adapted to provide information to the control circuitry. In this manner, the remote circuitry may be accessed by a user by accessing the battery cover which makes installation and/or repair of the head unit easier.

In one form, the battery cover includes a user interface operably connected to the remote circuitry. For example, the user interface may include buttons, lights, display, or other elements that may be used by the user to interact with the head unit. By providing the user interface on the battery cover, the user can readily access the battery and the user interface at a common location on the head unit.

In one form, the battery cover and remote circuitry thereof are removable from the body. This allows a user to easily replace the remote circuitry by removing and replacing the battery cover and remote circuitry thereof with a new battery cover and associated remote circuitry. As an example, the remote circuitry may include a Wi-Fi® processor and transceiver. In the event the Wi-Fi® processor fails, the user may repair the head unit by replacing the battery cover and without having to the replace the control circuitry. Other examples of situations that may precipitate replacement of the remote circuitry include lightning strikes, power line surges, and electrostatic discharge.

A movable barrier operator system is also provided including a rail and a trolley configured to be connected to a movable barrier and moved along the rail to cause movement of the movable barrier. The movable barrier operator system further includes a head unit adapted to utilize either a belt or a chain to drive the trolley. The head unit has rotatable drive member configured to engage and drive either of the belt and the chain. The movable barrier operator further includes a guide associated with the rail and having chain separating members adapted to spread portions of the chain apart and at least one belt backing member adapted to keep the belt engaged with the rotatable drive member. In this manner, the guide separates a chain if a chain is used with the head unit or keeps a belt engaged with the rotatable drive member if a belt is used with the head unit. This allows the head unit to be used with either a chain or a belt and without having to customize the head unit for a particular application.

In accordance with another aspect of the present invention, a guide is provided for guiding movement of either a belt or a chain driven along the rail of a movable barrier operator by a rotatable drive of the movable barrier operator. The guide includes a base adapted to be secured to a rail and at least one chain shifting member configured to shift a chain away from the rail. The at least one chain shifting member shifts the chain away from the rail adjacent the rotatable drive and takes up the space between the chain and the rail to limit the likelihood of contact creating noise. The guide further includes at least one belt backing member configured to keep the belt engaged with the rotatable drive. Thus, the guide may be secured to a rail and used to limit the pinch point of a chain or resist slippage of a belt depending on whether a chain or a belt is utilized by the movable barrier operator.

A head unit for a garage door operator is provided that includes a metallic chassis and a motor and a controller mounted to the chassis. The head unit includes a unitary, one-piece plastic housing sized to cover the motor and at least one releasable, snap-fit connection between the chassis and the housing that secures the housing to the chassis. The at least one releasable snap-fit connection permits the housing to be easily and quickly disconnected from the metallic chassis. In one form, the at least one releasable snap-fit connection includes a plurality of releasable snap-fit connections that, once released, permit the plastic housing to be removed from the metallic chassis without requiring the use of a tool.

In one form, the controller includes a power control board adapted to provide power to the motor and the head unit includes a fire-resistant container that contains mounted to the chassis the power control board. In this manner, the power control board may include components that operate at higher voltages, such as 120 volts. The fire-resistant container protects these components and may require a tool to open the fire-resistant container. Because the higher-voltage components may be provided in the power control board, the plastic housing may be removable without the use of tools while satisfying UL requirements.

In accordance with another aspect, a movable barrier operator system is provided including a head unit and a plurality of sections of a trolley supporting rail in a predetermined arrangement about the head unit. The trolley supporting rail sections include sections at opposite sides of the head unit to protect the head unit. The system further includes at least one support maintaining the trolley supporting rail sections in the predetermined arrangement about the head unit. By having the trolley supporting rail sections at opposite sides of the head unit to protect the head unit, the rigid trolley supporting rails provide strength to the movable barrier operator system.

In one form, the movable barrier operator system includes a container and the head unit, trolley supporting rail, and at least one support are in the container. The system thereby has a compact and organized configuration within the container. Further, the rail sections are arranged around and protect the head unit.

In one form, the at least one support includes end supports spanning between end portions of the sections of the trolley supporting rails at opposite sides of the head unit. The end supports may absorb loading during transit from the trolley rail sections and direct loading around the head unit.

In accordance with yet another aspect of the present invention, a trolley for a movable barrier operator is provided that includes a rail portion configured to be connected to a rail of the movable barrier operator and moved therealong. The trolley further includes a rotary tensioner connected to the rail portion and adapted to receive a portion of a belt of the movable barrier operator. The rotary tensioner is rotatable in a tensioning direction to draw the belt onto the rotary tensioner and tension the belt. The rotatory tensioner allows the belt to be wound thereon rather than linearly drawing the end of the belt toward another end of the belt as is done in some prior approaches. This linear tensioning in prior approaches utilizes a bolt and a tension spring and may be non-intuitive for some users.

In one form, the trolley further includes a resilient member configured to resist rotation of the rotary tensioner in a release direction. The resilient member thereby resists paying out of the belt from the rotary tensioner. The rotary tensioner may include gear teeth, the trolley may include another rotary tensioner having gear teeth, and the resilient member may be drawn into the mesh between the gear teeth in response to the movement of the rotary tensioners in payout directions. The engagement between the gear teeth and the resilient members resists turning of the rotary tensioners in the payout directions. This locks the rotary tensioners in place and maintains the tension in the belt.

DETAILED DESCRIPTION

Figure 1:
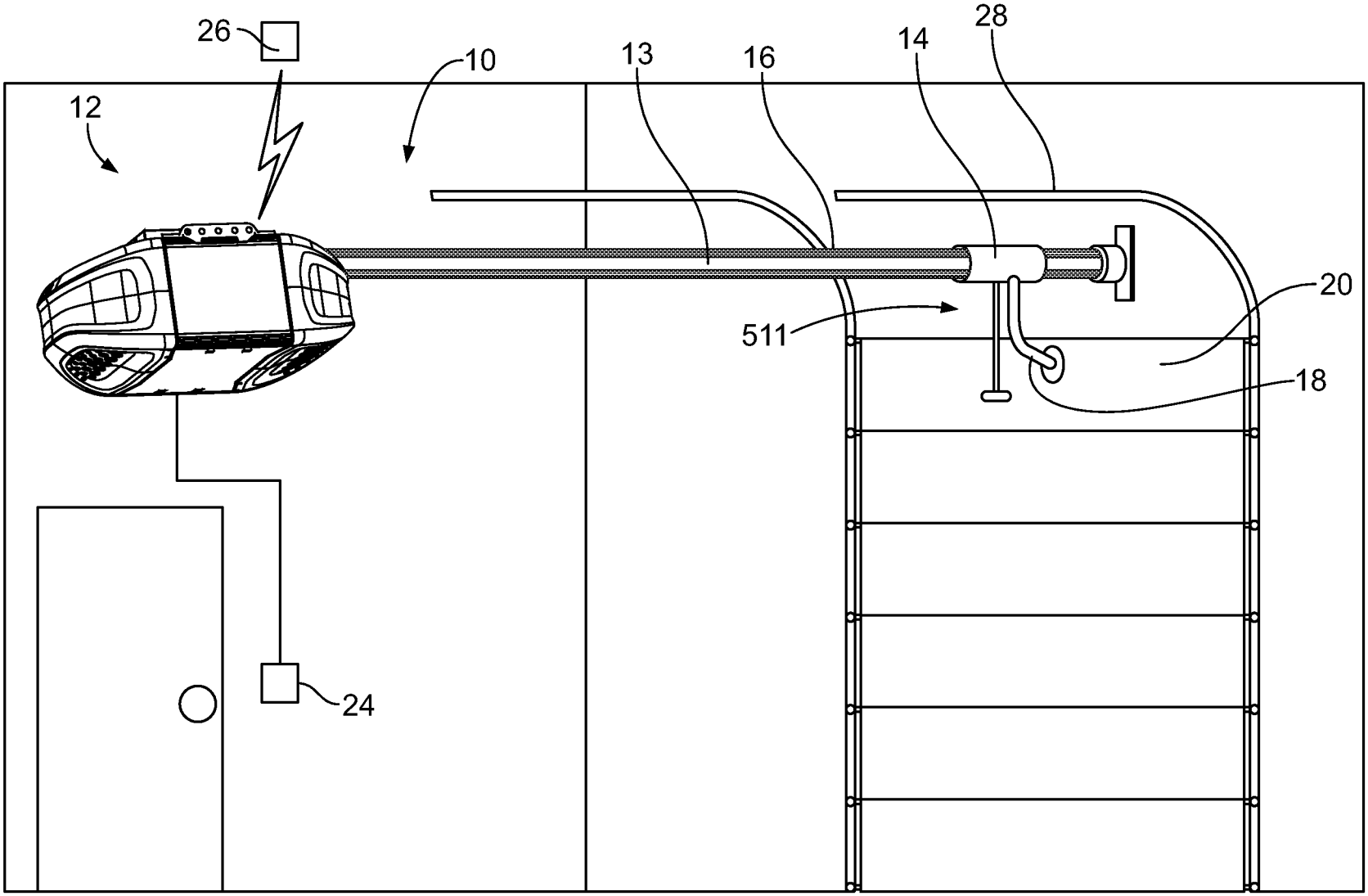
FIG. 1 is a perspective view of a movable barrier operator system installed in a garage.

With reference to FIG. 1, a movable barrier operator system 10 is provided that includes a movable barrier operator, such as a head unit 12, as well as a rail 13, a trolley 14 movable along the rail 13, and an elongate member such as a chain or belt 16 connected to the trolley 14. The trolley 14 includes an inner trolley assembly 500 (see FIG. 28A) mounted to the rail 13 and an outer trolley assembly 507 (see FIG. 28B) connected to a trolley arm 18 which is in turn connected to a movable barrier, such as a garage door 20. The trolley 14 includes a release mechanism 511 for disconnecting the outer trolley assembly 507 from the inner trolley assembly 500. The head unit 12 may be operated to by a number of remote control devices, such as a wall-mounted switch 24 and a remote radio frequency transmitter 26. As another example, the head unit 12 may be connected via a wired or wireless connection to a network, such as the internet, so that a user may operate the head unit 12 using an electronic device, such a smart phone. The head unit 12 moves the belt 16 to move the trolley 14 and garage door 20 connected thereto between closed and open positions. In one form, the garage door 20 is a segmented door with each segment having rollers received in rails 28 that guide and support the garage door 20 as it moves between closed and open positions.

Figure 2:
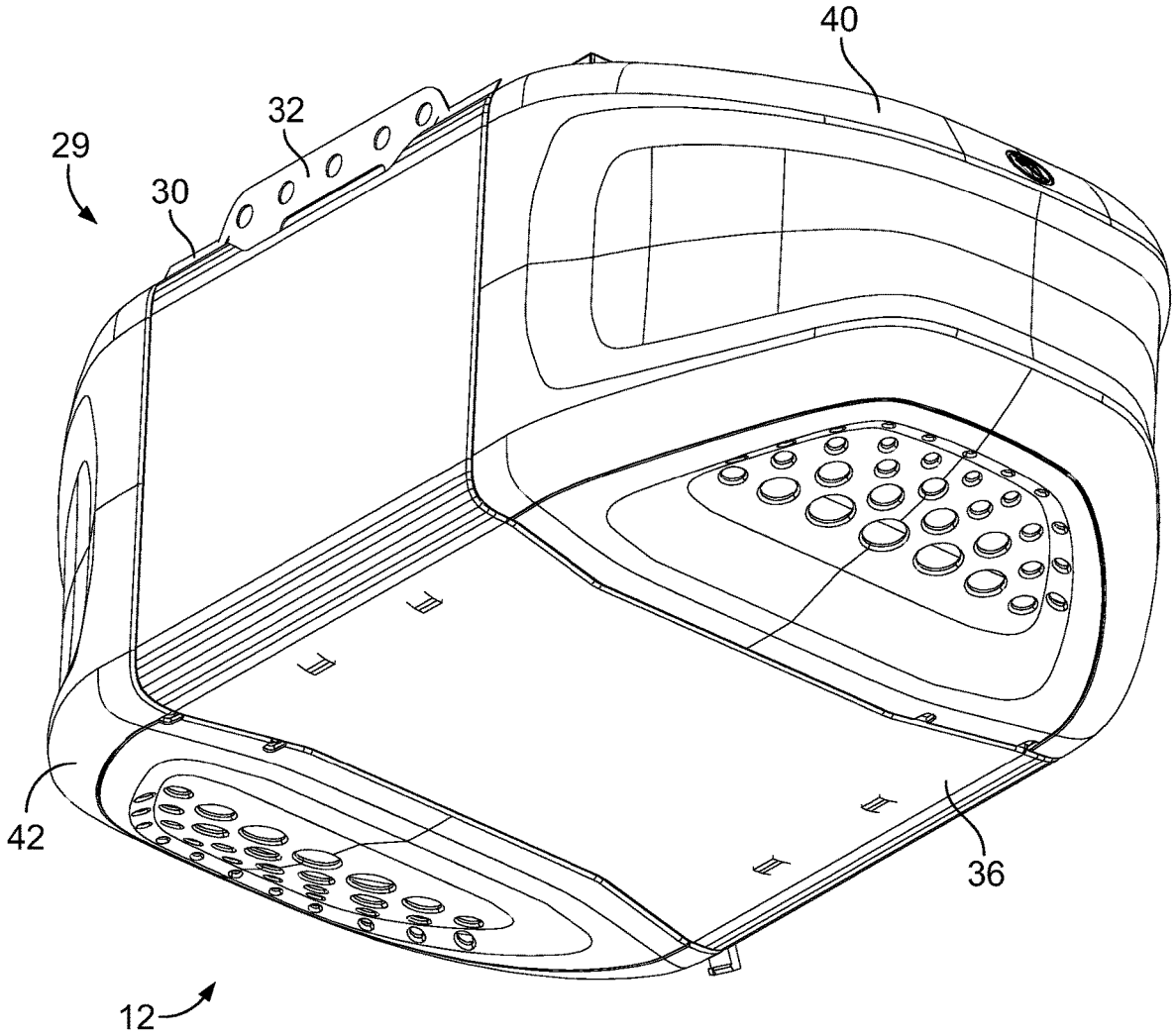
FIG. 2 is a bottom perspective view of a head unit of the movable barrier operator system of FIG. 1 showing lens covers at opposite ends of the head unit.
Figure 3:
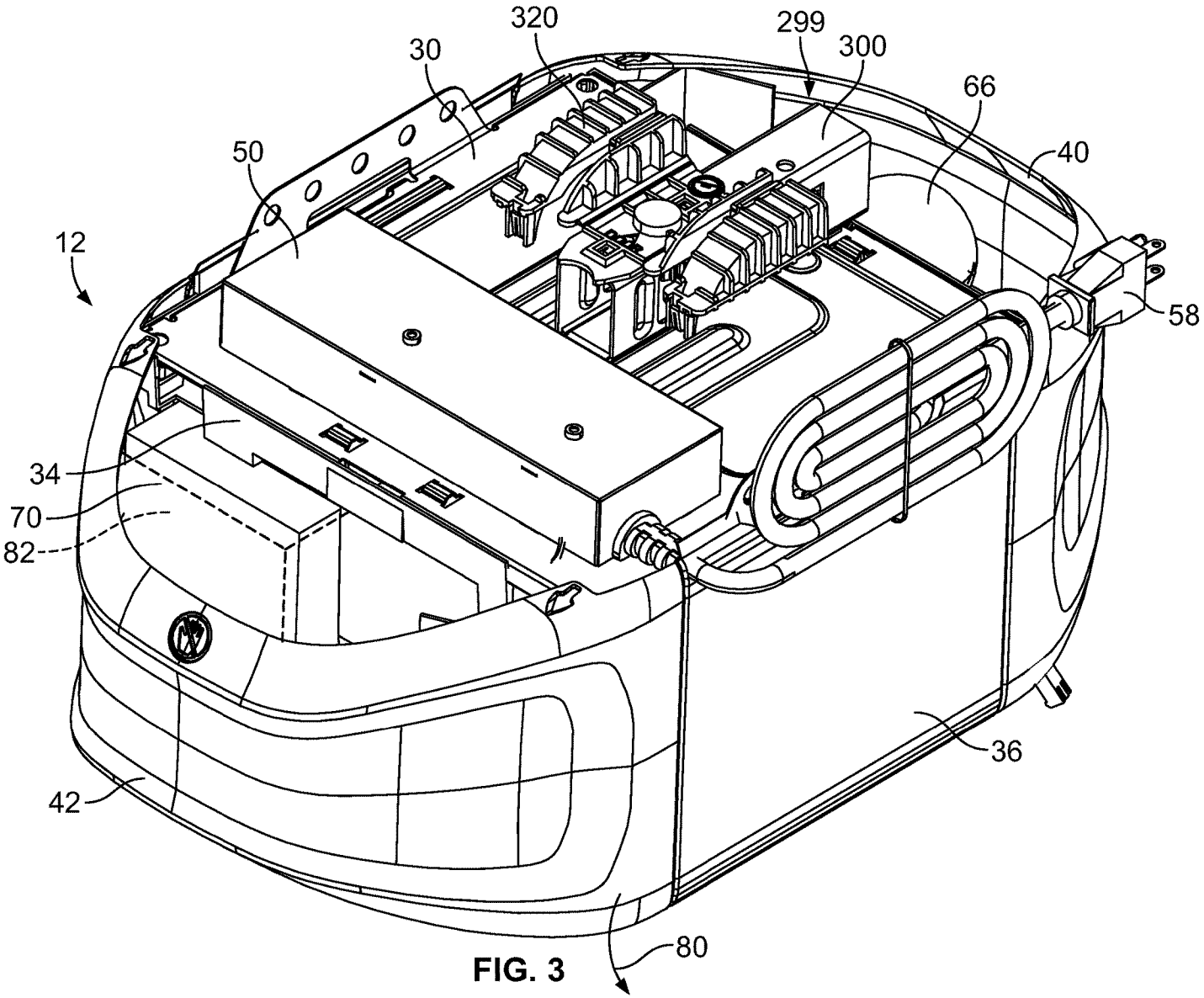
FIG. 3 is a top perspective view of the head unit of FIG. 2 showing a fire-resistant container mounted to a chassis of the head unit.

With reference to FIGS. 2 and 3, the head unit 12 has a body 29 including a chassis 30 and a housing 34. The chassis 30 has mounting brackets 32 for being secured to a support structure. The housing 34 is releasably connected to the chassis 30 and may be removed from the chassis 30 without the use of tools. The head unit 12 includes a shell 36 that provides additional rigidity to the head unit 12 and may be colored to provide a desired appearance of the head unit 12. The head unit 12 has translucent lens covers 40, 42 that diffuse light from lightbulbs 66. The shell 36 and lens covers 40, 42 may be removed from the housing 34 without the use of tools. This permits a user to readily access the housing 34 and internal components of the head unit 12.

Figure 4:
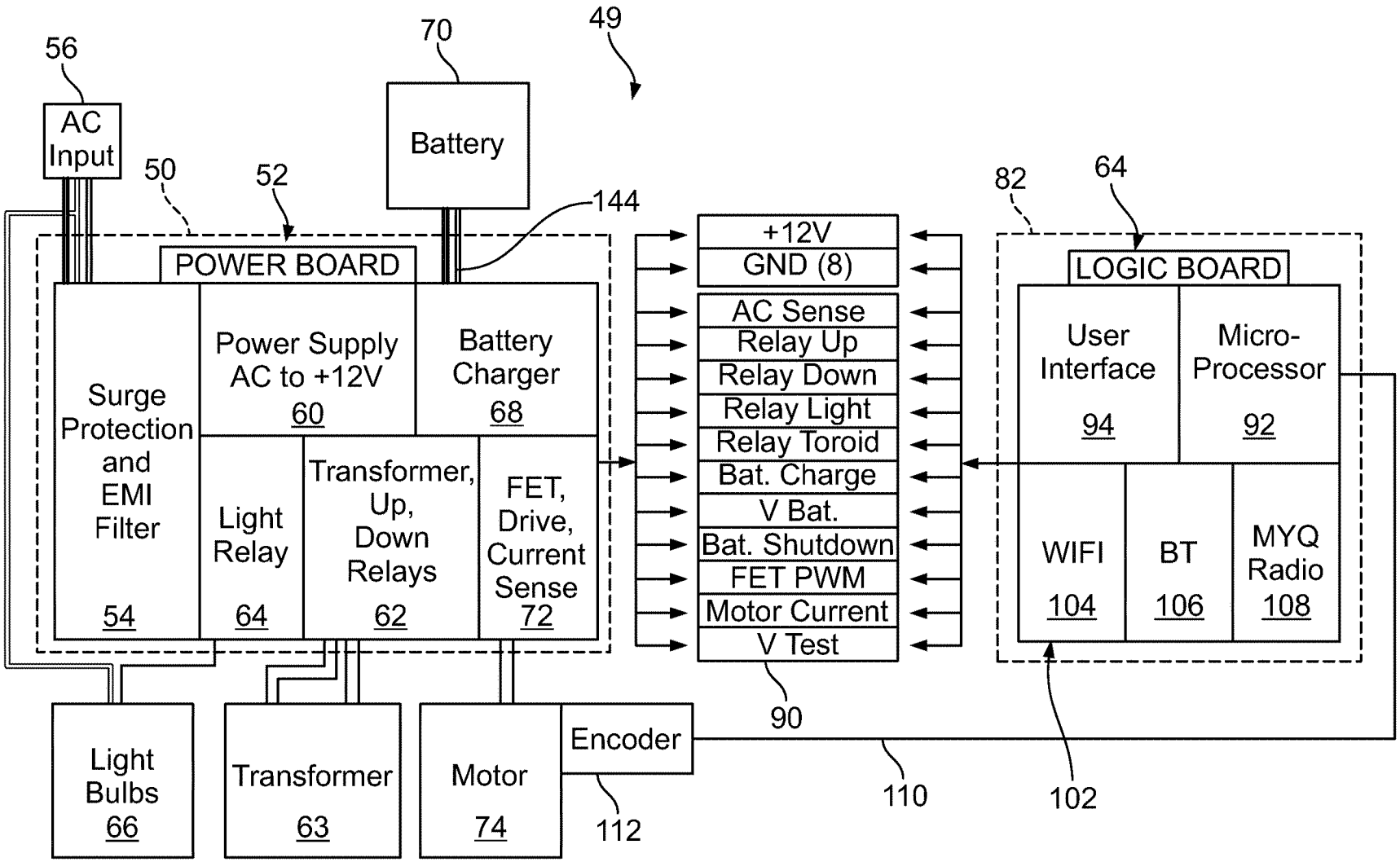
FIG. 4 is a schematic view of an electrical circuit of the head unit of FIG. 2 showing a first circuit board inside the fire-resistant container and a second circuit board outside of the fire-resistant container.

With reference to FIGS. 3 and 4, the head unit 12 has a controller 49 that includes a first circuitry board, such as a power board 52, and a second circuit board, such as a logic board 64. The head unit 12 includes a vault or fire-resistant container 50 that contains the power board 52. As used herein, the phrase the container 50 contains the power board 52 is intended to refer to the operative components of the power board 52 being within the fire-resistant container 50. Non-operative components, such as the substrate of the power board 52, may be disposed outside of the container. The power board 52 includes a surge protection and electromagnetic interference (EMI) filter 54 that receives power from an alternating current (AC) input 56. In one example, the AC input 56 includes an electrical cord 58 adapted to be connected to an electrical mains power supply. In one form, the electrical mains power supply provides power at a high voltage, such as 120 volts or higher, and the electrical cord 58 may be adapted to plug into an electrical socket providing the high voltage electrical power.

The power board 52 includes a power supply 60 and transformer up, down relays 62. The EMI filter 54, power supply 60, and relays 62 include circuitry that operates at higher voltage, such as 120 volts. The power board 52 may also include a light relay 64 for providing power to the light bulb 66, a battery charger 68 for charging a battery 70, and a motor power module 72. The motor power module 72 may include a field effect transistor, drive circuitry, and current sensing circuitry. The motor power module 72 provides power to a motor 74 of the head unit 12. One or more of the components 54, 60, 62, 64, 68, and 72 may utilize high voltage, such as 120 volts. Because the components 54, 60, 62, 64, 68, and 72 are within the fire-resistant container 50, the power board 52 may conform to various electrical standards such as those promulgated by UL. Further, the other components of the controller 49 that do not utilize high voltage, such as the logic board 64, may be positioned outside of the fire-resistant container 50. The components of the logic board 64 utilize low voltage power, such as 24 volts or less, or 12 volts or less.

With reference to FIG. 3, the battery 70 is removable from the head unit 12 by pivoting the lens 42 downward in direction 80. The head unit 12 may further include a battery cover 82 that may be slidable or pivotal relative to the housing 34 to prevent access to the battery 70. In one form, the battery cover 82 includes the logic board 64. Because the battery cover 82 includes the logic board 64, the logic board 64 may be easily accessed by a user. Further, the logic board 64 is outside of the fire-resistant container 50 so that the user does not have to open the fire-resistant container 50 to access the logic board 64. Yet another advantage of the battery cover 82 including the logic board 64 is that the battery cover 82 and the logic board 64 thereof may be removable from the head unit 12 so that a user can simply replace the battery cover 82 and logic board 64 in the event a component of the logic board 64 fails. This allows the user to replace the logic board 64 without having to replace or even access the power board 52.

Figure 7:
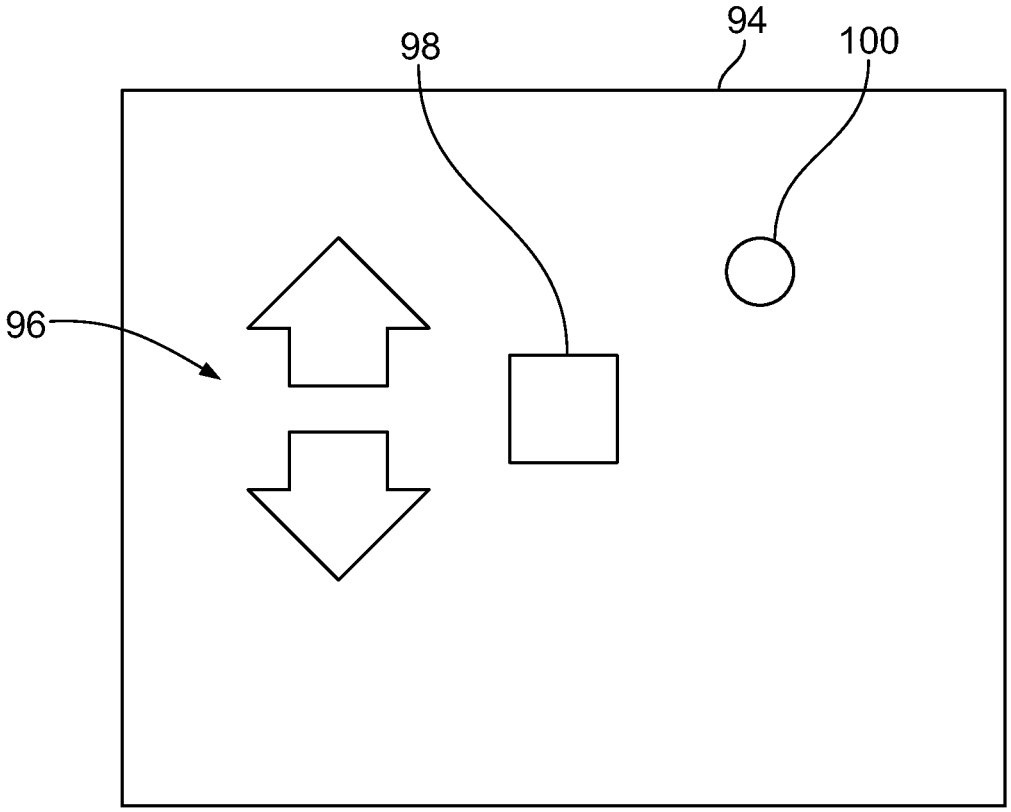
FIG. 7 is a schematic view of a user interface of the battery cover of FIG. 6.

With reference to FIG. 4, the controller 49 includes a communication interface 90 that permits communication between the power board 52 in the fire-resistant container 50 and the logic board 64 outside of the fire-resistant container 50. In one form, the logic board 64 includes a main microprocessor 92 and a user interface 94. With reference to FIG. 7, the user interface 94 may include one or more buttons, such as force control buttons 96 and a learn mode button 98. The user interface 94 may include one or more lights, such as a LED 100. The user interface 94 may include other types of interfaces, such as a display, a speaker and microphone, a joystick, and other devices. Returning to FIG. 4, the logic board 64 includes at least one wireless communication interface 102. The at least one wireless communication interface 102 may include several interfaces such as a Wi-Fi® module 104, a Bluetooth® module 106, and a MyQ® module 108. The MyQ module 108 utilizes a frequency hopping spread spectrum ISM 900 mHz. Each of the modules 104, 106, 108 may include a processor and a transceiver configured to transmit and receive signals according to the associated wireless standard. In another form, the controller 49 has a central processor such as the microprocessor 92 that directs the modules 104, 106, 108.

The microprocessor 92 of the logic board 64 communicates via a connection 110 with an encoder 112 coupled to the motor 74. The microprocessor 92 may thereby monitor the operation on the motor 74 and control the motor 74 by sending signals to the motor control 72. The encoder 112 and the connection 110 are also outside of the fire-resistant container 50 and may be repaired without having to open the fire-resistant container 50.

Figure 5:
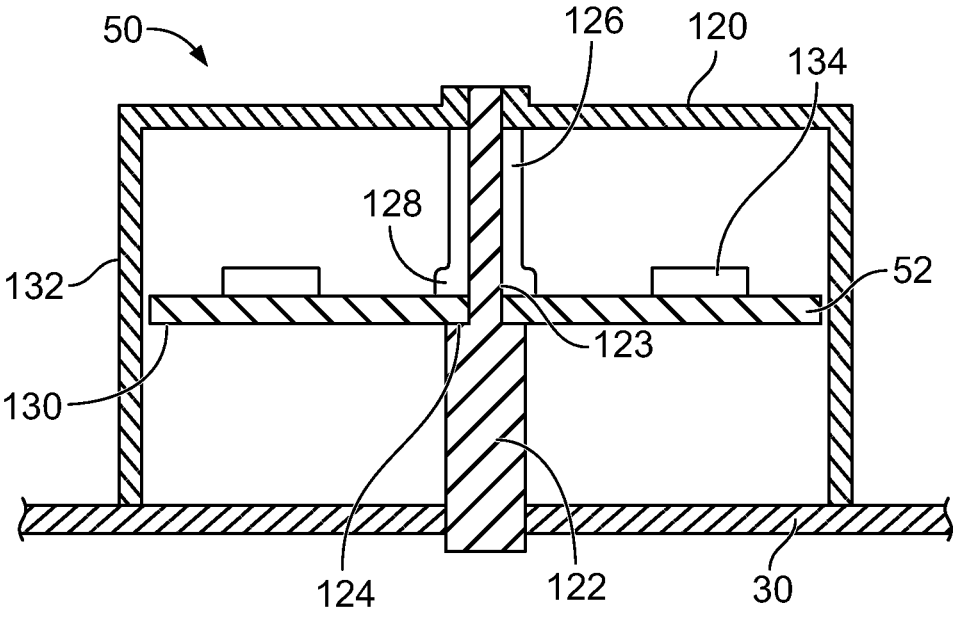
FIG. 5 is a schematic cross-sectional view of the first circuit board in the fire-resistant container.
Figure 6:
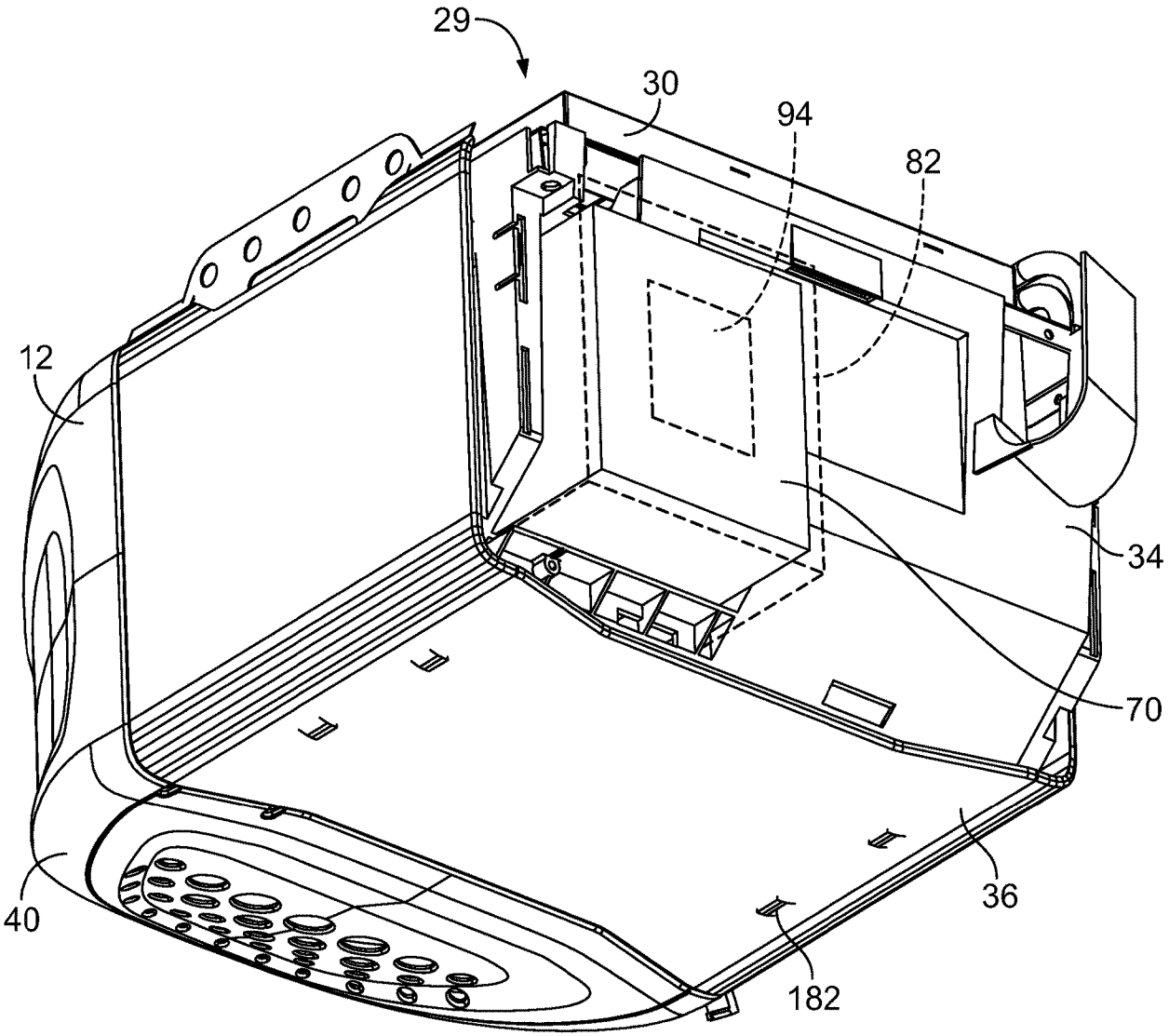
FIG. 6 is a bottom perspective view similar to FIG. 2 with one of the lens covers removed to show a battery cover of the head unit in dashed lines.

With reference to FIG. 5, a schematic, cross-sectional view of the power board 52 in the fire-resistant container 50 is provided. In one form, the fire-resistant container 50 includes a metallic box 120 mounted to the chassis 30. A post 122 extends through an opening 123 of the power port 52. The post 122 includes a ledge 124 supporting the power board 52 above the chassis 30. A capture member 126 may be deformed during assembly to create a bulge 128 that captures the power board 52 between the bulge 128 and the ledge 124 at a vertical position in the box 120. In one form, peripheral sides 130 of the power board 52 are spaced from walls 132 of the box 120. Additionally, the power board 52 may include various components 134 that are distributed on the power board 52. The components 134 may include, for example, the surge protector and EMI filter 54, power supply 60, transformer up, down relays 62, etc. With reference to FIG. 6, the lens cover 42 and associated light bulb 66 have been removed to show that the battery cover 82 and user interface 94 are readily accessible.

Figure 8:
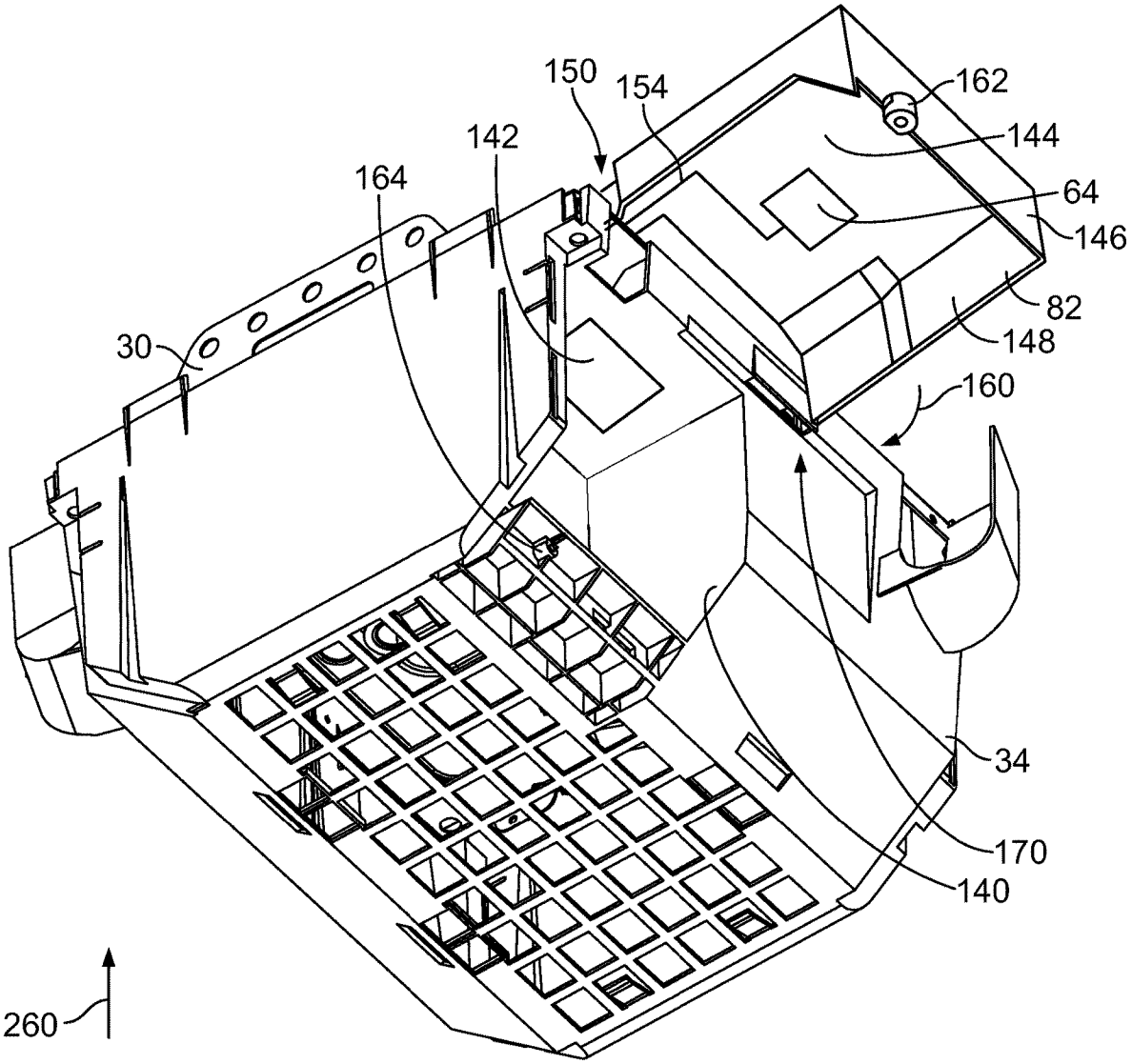
FIG. 8 is a bottom perspective view of the head unit of FIG. 6 with the battery cover shown in solid in an open position and the other lens cover and a shell of the head unit removed to show a housing of the head unit.

Turning to FIG. 8, the head unit 12 is shown with the shell 36 and lenses 40, 42 removed. The battery cover 82 is shown in solid and the battery 70 has been removed. The housing 34 may have a one-piece, unitary construction and may be made of a plastic material. The housing 34 includes structures to receive various components of the head unit 12 including a battery compartment 140. The battery compartment 140 may include therein a battery station 142 that receives the battery 70 and is connected via an electrical connection 144 (see FIG. 4) to the battery charger 68. The battery station 142 may have a plurality of terminals that contact terminals of the battery 70 when the battery 70 is positioned in the battery compartment 140. The battery station 142 permits electrical power to flow from the battery charger 68 to the battery 70 when the AC input 56 provides power to the power board 52. The battery station 142 also permits electrical power to flow from the battery 70 to the power board 52 when the AC input 56 is off, such as during a power outage.

The battery cover 82 may include a front wall 144, side walls 146, and a cavity 148 that receives a portion of the battery 70 once the battery cover 82 is in the closed position thereof. The head unit 12 may include a hinged connection 150 connecting the battery cover 82 to the chassis 30. In one form, the logic board 64 is mounted to an inner surface of the front wall 144 of the battery cover 82. The logic board 64 has one or more electrical connections 154 connecting the logic board 64 to the communication interface 90 and the encoder connection 110. The one or more electrical connections 154 may be physically disconnected from the communication interface 90 and the encoder connection 110, such as by separating mechanical connectors of the electrical connections 154 from mechanical connectors of the communication interface 90 and encoder connection 110. Further, the hinged connection 150 may be releasable. Thus, in the event one of the components of the logic board 64 fails, the user may disconnect the mechanical connectors of the one or more electrical connections 154 and release the hinged connection 150 to remove the battery cover 82. The user may then replace the battery cover 82 with a new battery cover 82 that includes a new logic board 64. The new battery cover 82 and logic board 64 may then be mechanically connected to the hinge connection 150 and electrically connected to the communication interface 90 and encoder connection 110. The battery cover 82 may be pivotal from the open position of FIG. 8 to a closed position in direction 160. The battery cover 82 and the housing 34 may have tubes 162, 164 that are aligned and joined using a fastener to maintain the battery cover 82 in the closed position thereof. In another form, the battery cover 82 is slidable between a first position wherein the battery cover 82 restricts removal of the battery 70 and a second position wherein the batter cover 82 permits removal of the battery 70. In yet another form, the battery cover may be connected to the housing 34 using interlocking tabs and slots such that the battery cover 82 has a first position wherein the battery cover 82 is connected to the housing 34 and restricts removal of the battery 70 and a second position wherein the battery cover 82 is mechanically disconnected from the housing 34 and permits removal of the battery 70.

Figure 9:
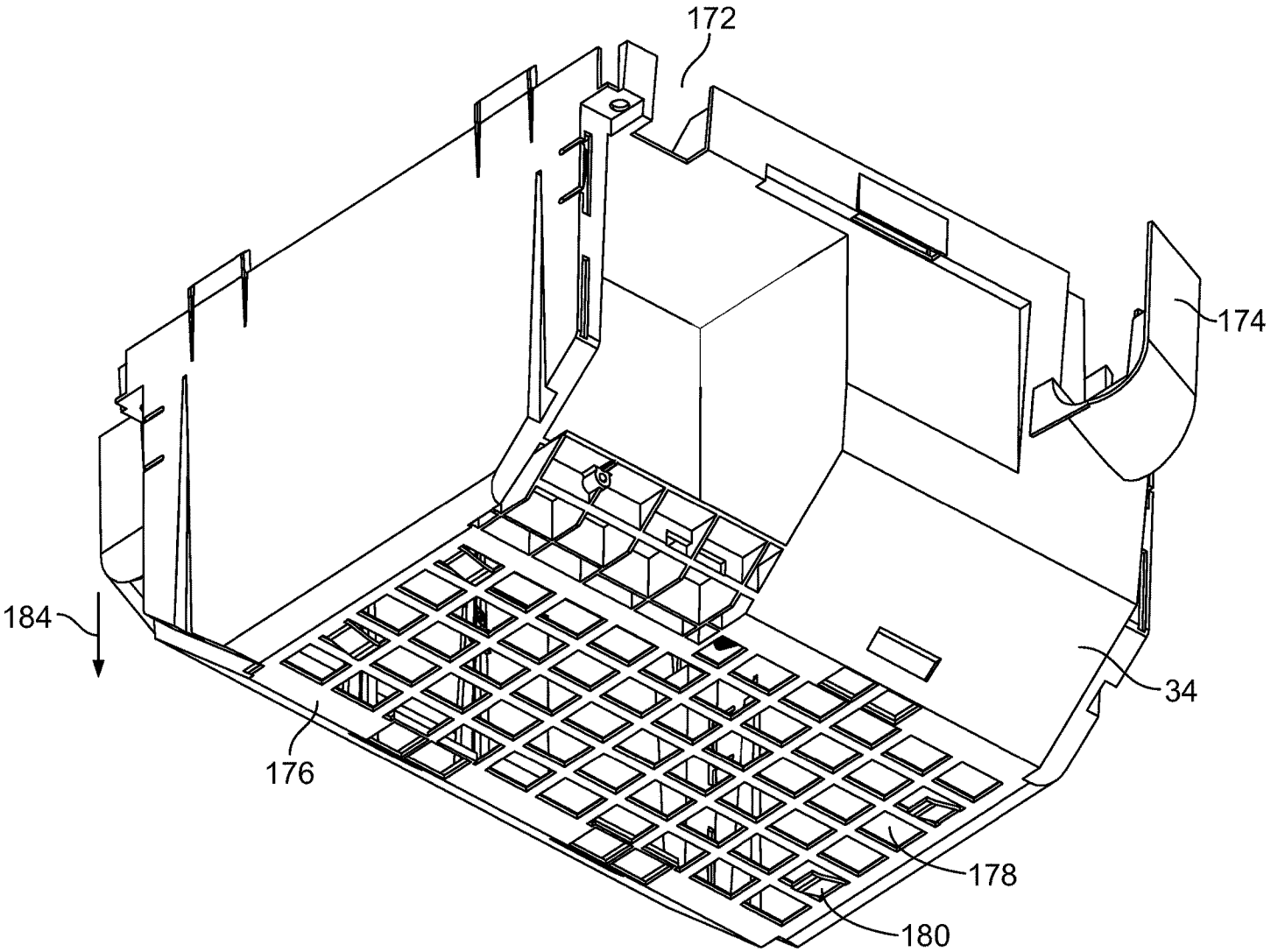
FIG. 9 is a bottom perspective view of the housing of FIG. 8 showing a cavity for receiving the battery.

With reference to FIGS. 8 and 9, the housing 34 and chassis 30 are joined by one or more snap-fit connections 170. The snap-fit connections 170 permit the housing 34 to be easily connected to and disconnected from the chassis 30 without requiring the use of a tool. The one or more snap connections 170 will be discussed in greater detail below with respect to FIGS. 12-19.

With reference to FIG. 9, the housing 34 includes a socket shield 174 that extends around a socket for one of the light bulbs 66. The light bulb socket may be mounted directly to the chassis 30 to form a rigid support for the light bulb 66. The socket shield 174 protects the light socket from damage. The housing 34 includes a bottom wall 176 with one or more openings 178 that reduce the amount of material required for the housing 34. The bottom wall 176 also includes detents 180 that engage recesses 182 (see FIG. 6) of the shell 36 to retain the shell 36 on the housing 34. The detents 180 allow the user to disengage the shell 36 from the housing 34 by pulling the shell 36 downward in direction 184.

Figure 10:
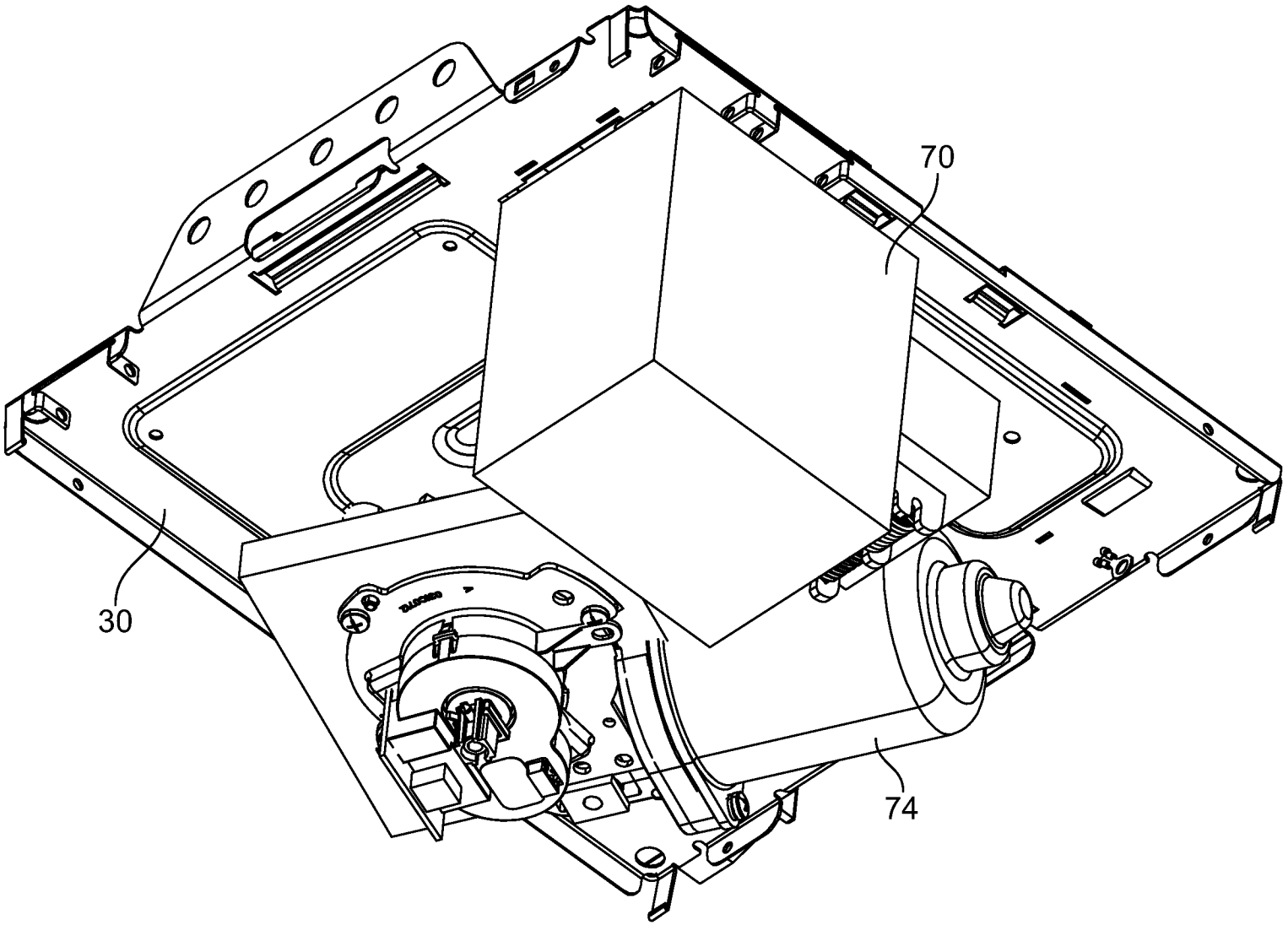
FIG. 10 is a view similar to FIG. 6 with the housing and battery cover removed to show a motor and a battery of the head unit.
Figure 11:
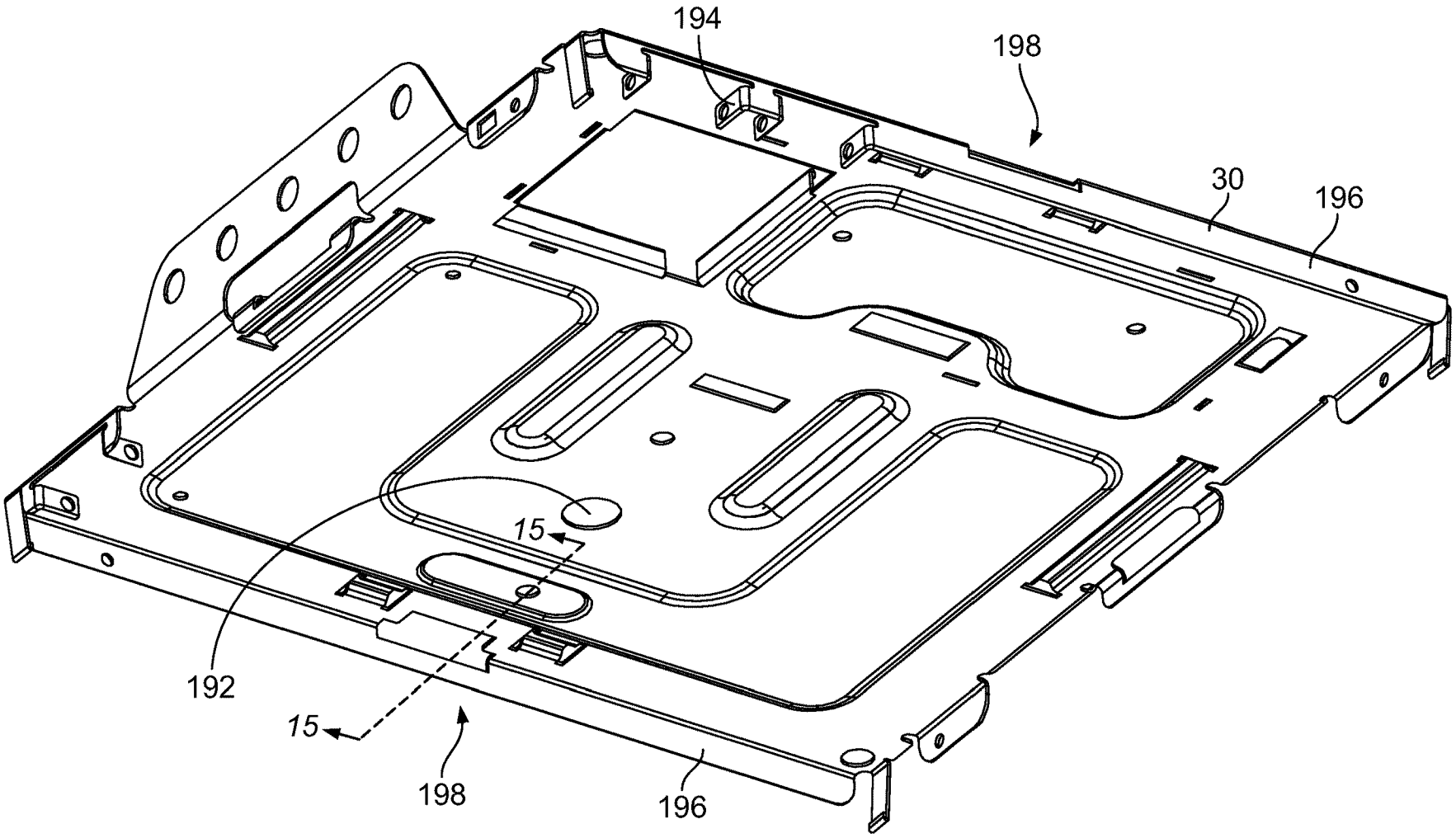
FIG. 11 is a view similar to FIG. 10 with the battery and motor removed to show the chassis.

With reference to FIG. 10, the chassis 30 is shown with the battery 70 connected thereto and the motor 74 mounted to the chassis 30. The motor 74 has a drive shaft 190 (see FIG. 20) that extends through an opening 192 (see FIG. 11) of the chassis 30. The motor 74 is mounted to the chassis 30 on an opposite side of the chassis 30 from the power board 52, which is contained in the fire-resistant container 50. The chassis 30 may have a one-piece, unitary construction and may be made from, for example, a metallic material such as steel. With reference to FIG. 11, the chassis 30 has various structures to accommodate the components mounted to the chassis 30 including hinged brackets 194 that are a part of the hinged connection 150 with the battery cover 82.

Figure 12:
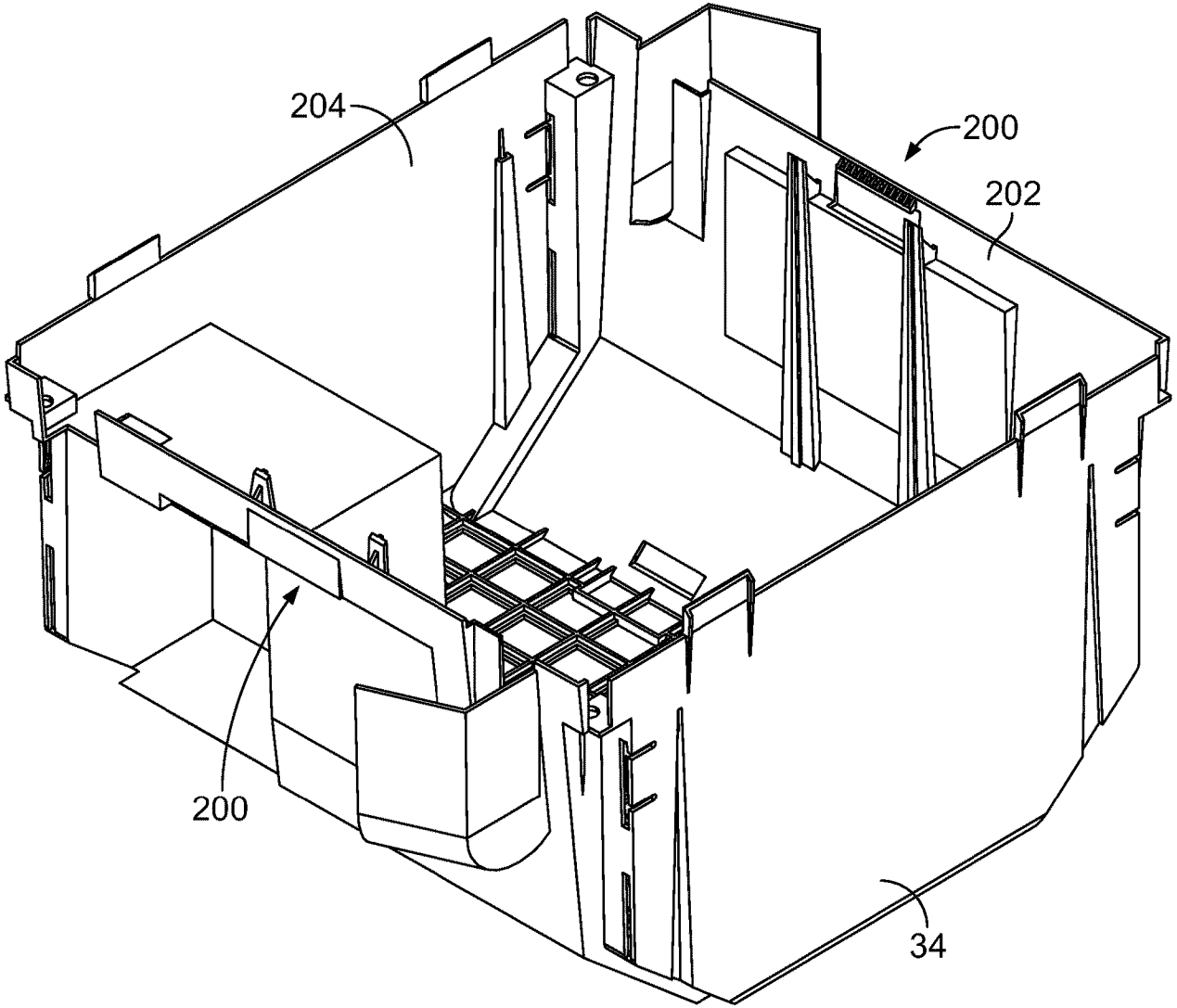
FIG. 12 is top perspective view of the housing of FIG. 9 showing portions of the housing that form snap-fit connections with corresponding portions of the chassis.

With reference to FIGS. 11 and 12, the head unit 12 includes two snap-fit connections 170 that each include mounting portions 198, 200 of the chassis 30 and the housing 34. The chassis 30 has raised outer walls 196 extending around the periphery of the chassis 30 and the chassis mounting portions 198 includes portions of the outer walls 196. The housing 34 includes outer walls 202 that extend about a compartment 204 of the housing 34 and the housing mounting portions 200 include portions of the outer walls 202. The housing 34 is sized so that the housing outer walls 202 are outside of the chassis outer walls 196 when the housing 34 is connected to the chassis 30. The compartment 204 defined in part by the housing outer walls 202 is sized to receive various components of the head unit 12 including the motor 74.

Figure 13:
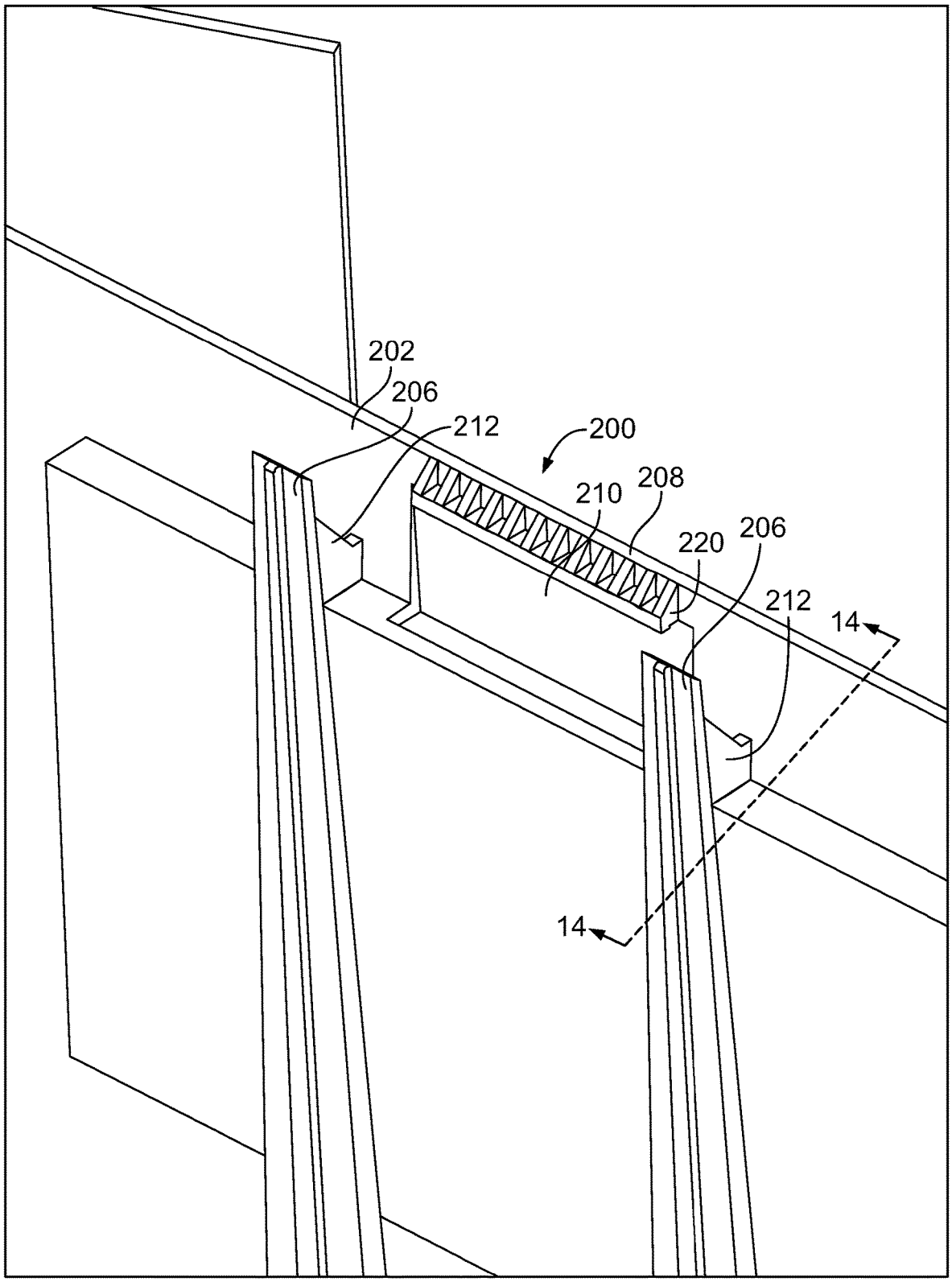
FIG. 13 is an enlarged view of a portion of FIG. 12 showing an outer wall of the housing having an engagement member for engaging the chassis.

With reference to FIG. 13, each housing mounting portion 200 includes one or more tensioning members 206 and an engagement member 208 of the outer wall 202. The outer wall 202 includes an opening 210 that increases the flexibility of the outer wall 202 at the engagement member 208. The housing portion 200 includes a web 212 connecting each of the tensioning members 206 to the outer wall 202. When the housing 34 is connected to the chassis 30, the tensioning members 206 operate to pull the outer wall 202 and engagement member 208 thereof firmly against the chassis 30. The tensioning members 206 pull the outer wall 202 by being shifted by the chassis 30 away from the chassis outer wall 202 and this shifting applies tension to the webs 212 which, in turn, pull the outer wall 202 inwardly against the chassis outer walls 196. This keeps the outer wall 202 of the housing 34 taught against the chassis 30.

Figure 14:
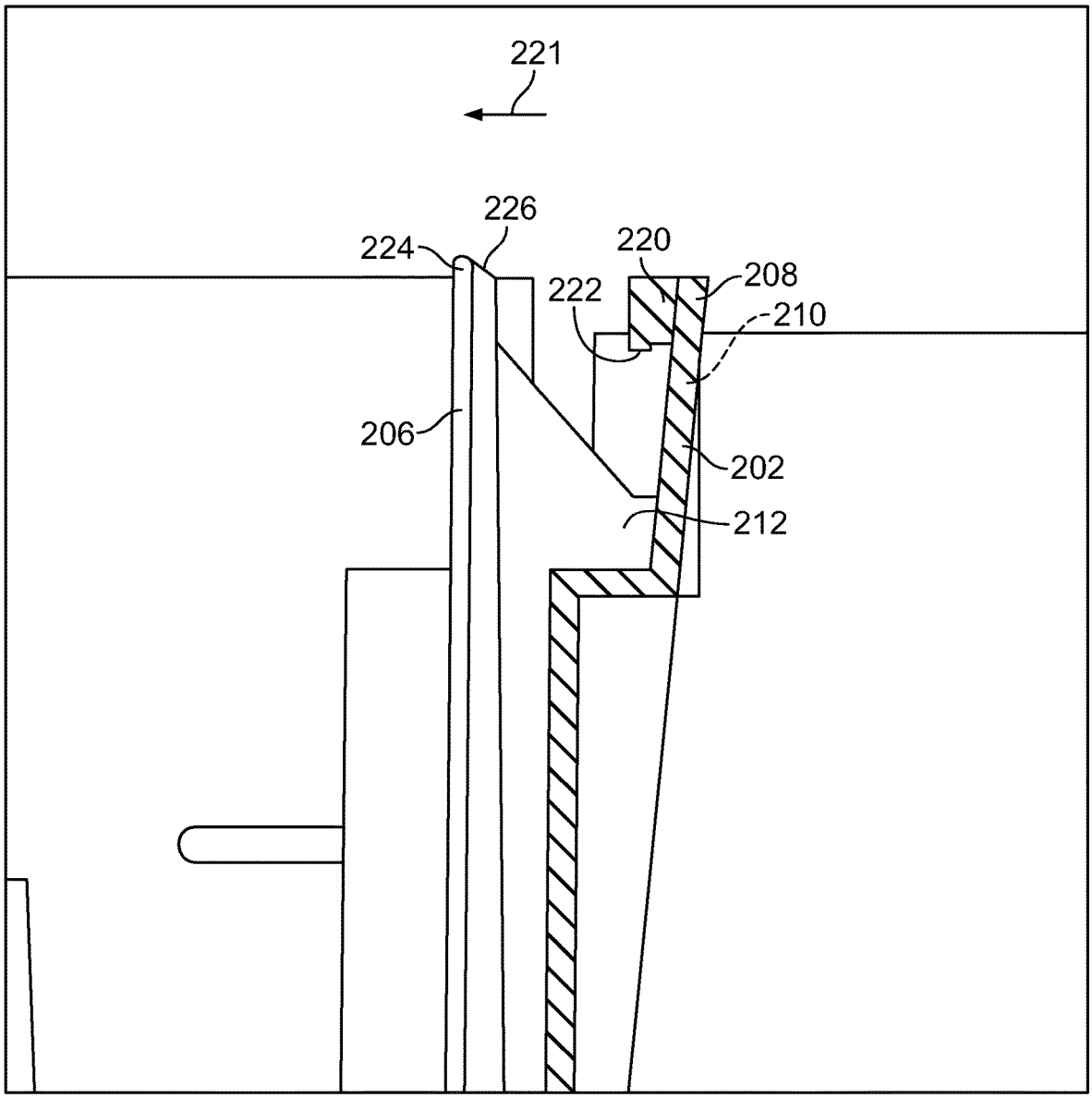
FIG. 14 is a cross-sectional view taken across line 14-14 in FIG. 13 showing a projection of the engagement member extending outward from the outer wall of the housing.

More specifically, with reference to FIG. 14, each of the engagement members 208 of the outer wall 202 includes an inwardly extending projection 220. The projection 220 includes a lip 222 that hooks around a support member 230 (see FIG. 15) of the chassis outer wall 196 and resists disengagement of the projection 220 from the chassis 30. The projection 220 is spaced from the tensioning members 206 and is connected thereto by the webs 212 and the outer wall 202. Thus, once the projection 220 is engaged with the chassis support member 230, shifting of the tensioning members 206 in direction 221 applies tension to the webs 212 in direction 221, which pulls the outer wall 202 in direction 221, and firmly engages the housing projection 220 with the chassis support member 230. To shift the tensioning member 206 in direction 221, the tensioning member 206 has a leading end portion 224 with a tapered surface 226 for camming against the chassis 30 and shifting in direction 221 as the housing 34 is connected to the chassis 30.

Figure 15:
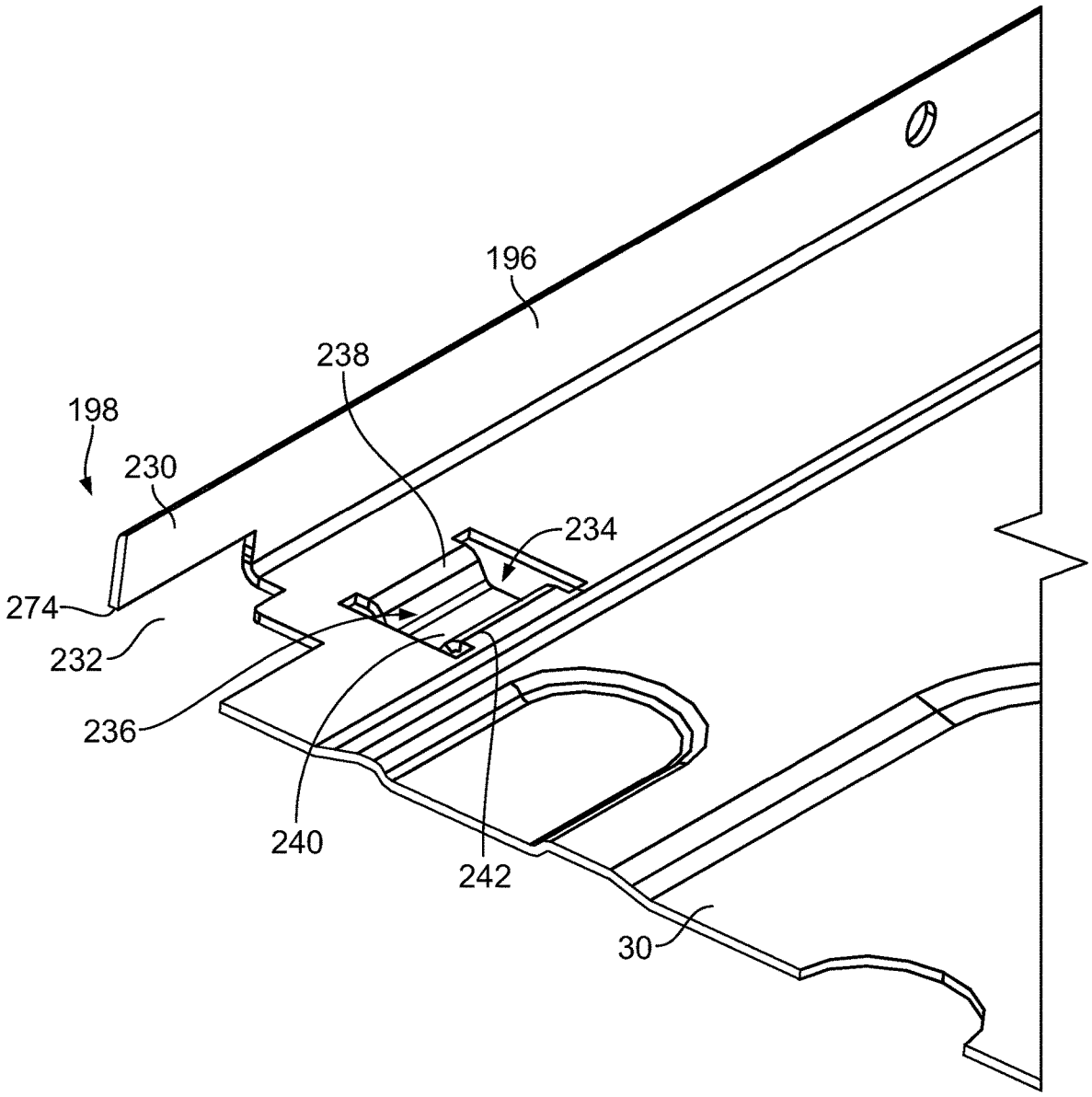
FIG. 15 is a perspective view of a portion of the chassis showing an outer wall of the chassis having a support member for engaging the engagement member of the housing.

With reference to FIG. 15, each chassis mounting portion 198 includes the support member 230 of the outer wall 196. The chassis mounting portion 198 includes an opening 232 below (as viewed in FIG. 15) the support member 230 that receives the housing projection 220 and permits the projection 220 to hook around the support member 230. The chassis 30 includes a housing shifting portion 234 configured to shift the leading end portion 224 of the tensioning member 206 in direction 222 (see FIG. 14) as the housing 34 is connected to the chassis 30. The housing shifting portion 234 includes a recess 236 for receiving the tensioning member leading end portion 224. The housing shifting portion 234 includes a cam wall 238 that engages the tapered surface 226 of the tensioning member 206, a floor 240, and a wall 242 extending away from the floor 240. The housing shifting portion 234 may be formed in the chassis 30 such as by stamping the housing shifting portion 234 into the chassis 30.

With reference to FIGS. 16-19, a process of engaging one of the snap-fit connections 170 of the head unit 12 is described. The process will be described with respect to one of the snap-fit connections 170, although a similar process occurs at the other snap-fit connection 170 substantially simultaneously as the user advances the housing 34 upwardly in direction 260 to connect the housing 34 to the chassis 30 mounted to a support structure. Thus, the housing 34 can be quickly connected to the chassis 30 by aligning the housing 34 with the chassis 30 and advancing the housing 34 in a fluid movement in direction 260 which substantially simultaneously engages the snap-fit connections 170. In another approach, the user may engage one snap fit connection 170 at a time, such as by connecting the snap fit connection 170 at one side of the housing 34 and rocking the housing 34 to engage the snap fit connection 170 at the other side of the housing 34. To disengage the housing 34 from the chassis 30, the user presses the housing 34 upwardly in direction 260 to lift the lip 222 into clearance with the chassis support member 230 and bends the outer walls 202 of the housing outwardly in direction 262 (see FIG. 19) to unhook the projections 220 from the chassis support member 230.

Figure 16:
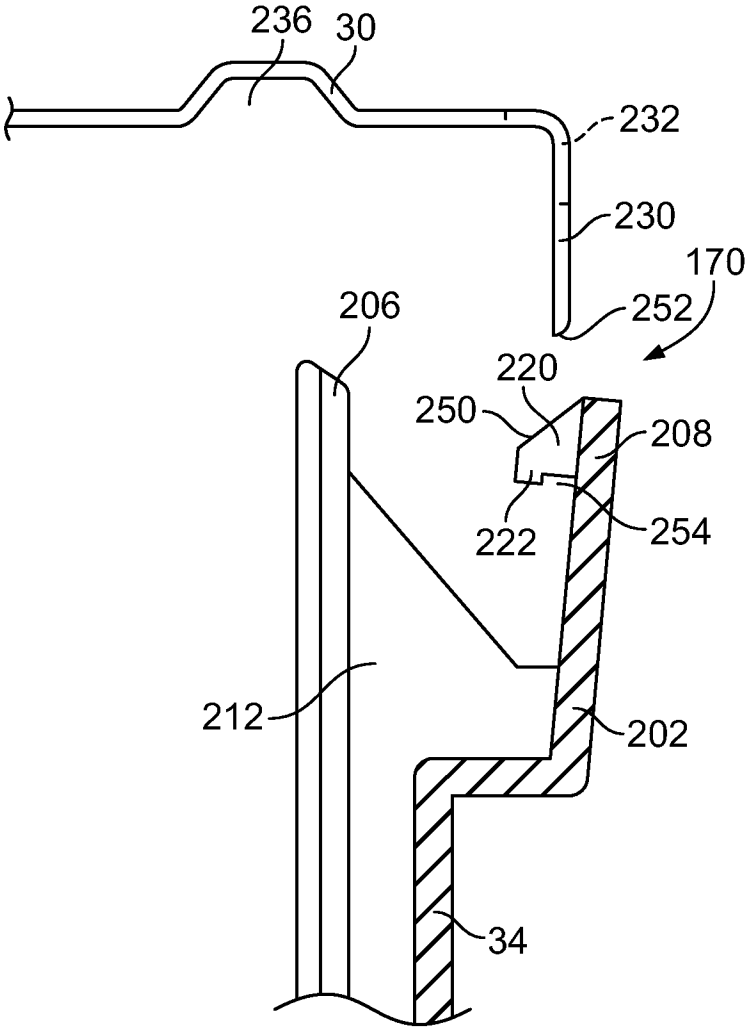
FIG. 16 is a schematic view similar to FIG. 14 showing the housing engagement member being advanced toward the support member of the chassis to form the snap-fit connection therebetween.

With reference to FIG. 16, the user positions the housing 34 below the chassis 30 so that the projection 220 of the engagement member 208 is generally aligned with the support member 230 of the chassis 30. As shown in FIG. 16, the projection 220 includes a cam surface 250 for engaging a surface 252 of the chassis support member 230. The projection 220 also includes a recess 254 that receives the chassis support member 230 when the projection 220 has hooked around the chassis support member 230.

Figure 17:
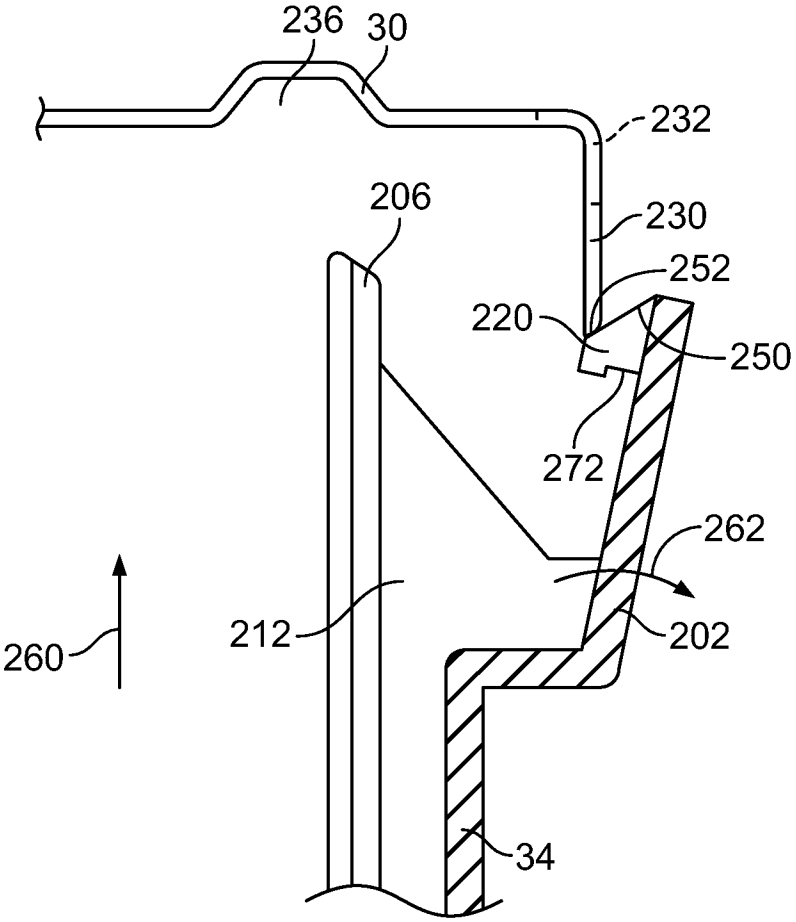
FIG. 17 is a view similar to FIG. 16 showing the support member of the chassis camming the engagement member of the housing outward and flexing the outer wall of the housing.

With reference to FIG. 17, the user advances the housing 34 in direction 260 to engage the surfaces 250, 252. This camming engagement shifts the projection 220 outward in direction 262. The opening 210 provides increased flexibility of the outer wall 202 in proximity to the projection 220 so that the outer wall 202 can flex and permit the projection 220 to ride outward and around the support member 230.

Figure 18:
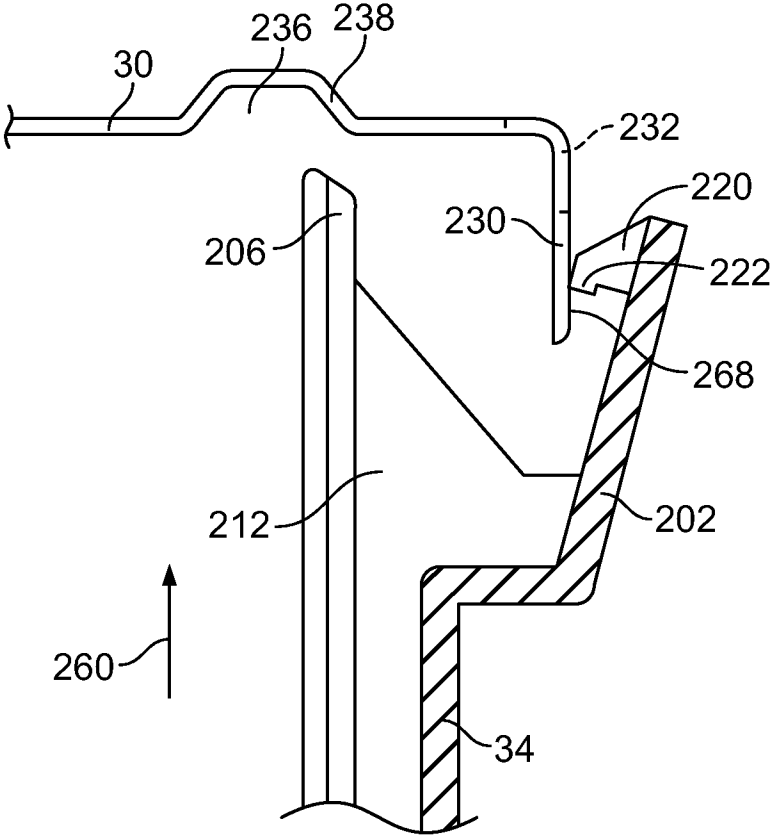
FIG. 18 is a view similar to FIG. 16 showing the projection sliding along the support member of the chassis.

With reference to FIG. 18, the user continues to advance the housing 34 upward in direction 260. The projection 220 slides along an outer surface 268 of the support member 230. Further, the tensioning members 206 travel toward the cam walls 238 of the chassis 30.

Figure 19:
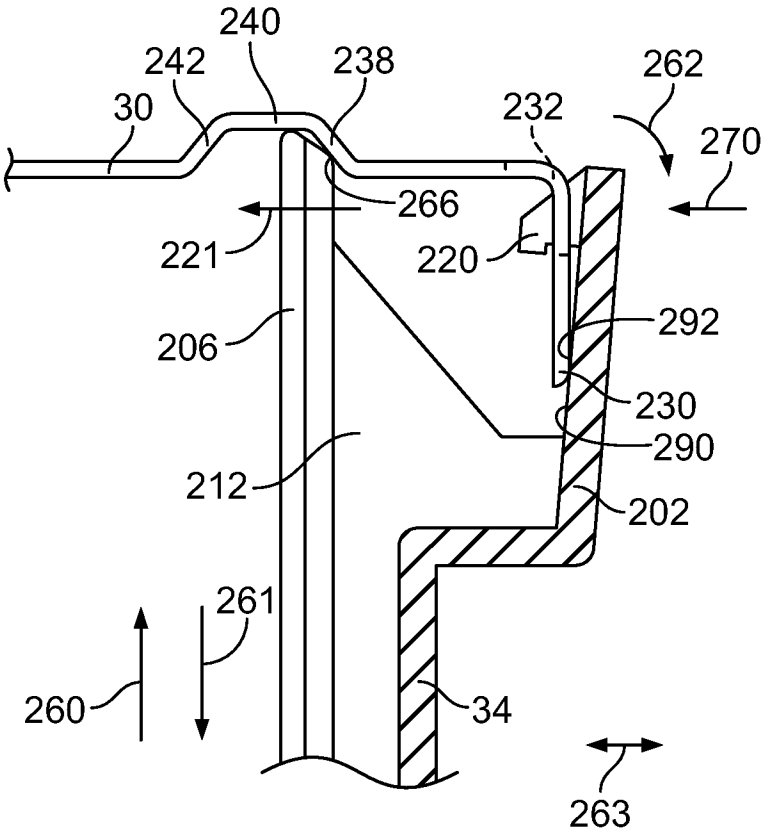
FIG. 19 is a view similar to FIG. 16 showing the engagement member of the housing engaging the support member of the chassis and a tensioning member of the housing being cammed away from the chassis support member to apply tension to the material of the housing and lock the housing onto the chassis.

With reference to FIG. 19, the user has advanced the housing 34 sufficiently far in direction 260 so that the projection 220 is horizontally aligned with the opening 232 of the chassis 30. The housing 34 may be made of a plastic material having resilient properties, such as polypropylene, which permits the housing wall 202 to resiliently urge the projection 220 in direction 202 into the opening 232. The housing projection 220 has a stop surface 272 (see FIG. 17) that abuts a stop surface 274 (see FIG. 15) of the chassis support member 230 when the support member 230 is received in the recess 254 of the projection 220. The abutting stop surfaces 272, 274 resist the housing 34 separating from the chassis 30 in vertical direction 261. Further, the chassis support member 230 and outer wall 196 of the chassis 30 are held between the lip 222 and the outer wall 202 of the housing 34 which resists lateral movement in lateral directions 263. In this manner, the housing 34 is locked onto chassis 30.

As the housing projection 220 reaches the chassis opening 232, the tapered surfaces 226 of each of the tensioning members 206 contacts the cam wall 238 of the chassis 30. The advancing of the housing 34 in direction 260 causes the cam wall 238 to shift the tensioning member 206 in direction 221 away from the support member 230 of the chassis 30. This shifting of the tensioning member 206 in direction 221 applies tension to the web 212. The web 212 transfers this tension and pulls the outer wall 202 in direction 221 as well. This tightly abuts an inner surface 290 of the housing outer wall 202 against an outer surface 292 of the chassis outer wall 196. In this manner, the outer walls 196, 202 are held together which resists disengagement of the projection 220 from the support member 230. In this manner, the tensioning members 206 and webs 212 keep the housing 34 locked onto the chassis 30 and resist unintentional disengagement of the housing 34 from the chassis 30.

Figure 20:
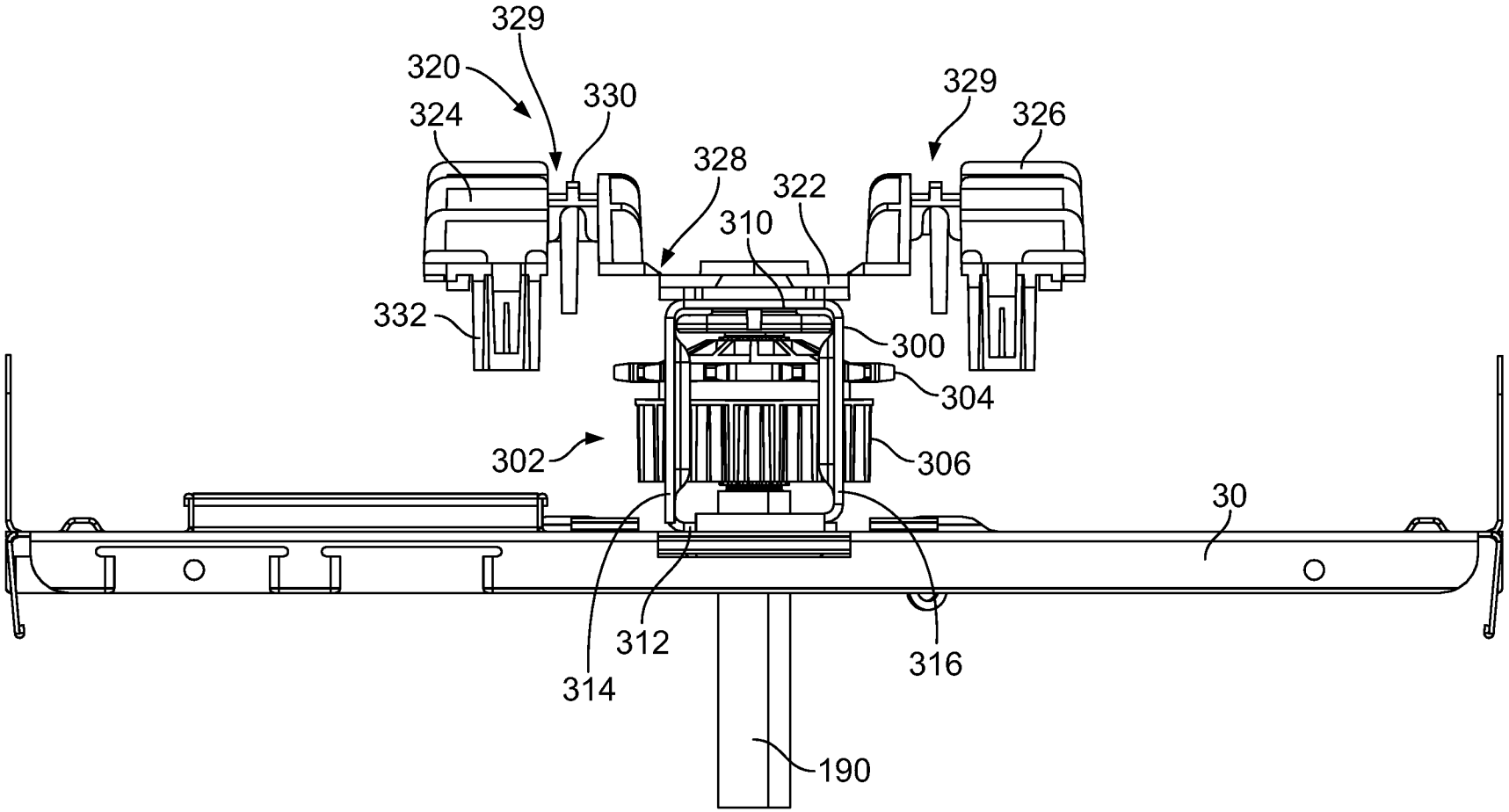
FIG. 20 is an elevational view of the chassis, a drive shaft of the motor, a rotatable drive member connected to the drive shaft, a rail section, and a guide connected to the rail section of the head unit of FIG. 2.

With reference to FIG. 3, the head unit 12 has a drive assembly 299 including a rail section 300 mounted to the chassis 30. Turning to FIG. 20, the drive assembly 299 includes a rotatable drive member 302 of the motor drive shaft 190 disposed in the rail section 300. The rotatable drive member 302 includes a drive pinion 304 configured to engage a chain and a drive pulley 306 configured to engage a belt. Because the rotatable drive member 302 includes both the drive pinion 304 and the drive pulley 306, the rotatable drive member 302 can be used to with either a chain or a belt. This allows one head unit 12 to be used for either a belt- or chain-based system. The rail section 300 includes a bottom wall 310, a top wall 312, and side walls 314, 316. The chain or belt connected to the rotatable drive member 302 extends along outer surfaces 319 of the side walls 314, 316 and into openings 317 (see FIG. 25) of the side walls 314, 316. The drive pinion 304 and the drive pulley 306 are aligned with the openings 317 of the rail section 300 and receive the belt or chain as the belt or chain extends through the openings 317 and across the rail section 300.

The head unit 12 includes a guide 320 for improving engagement of the chain or the belt with the associated drive pinion 304 and drive pulley 306. As shown in FIG. 20, the head unit 12 may be shipped with the guide 320 connected to the rail section 300. In other forms, the guide 320 may be separate from the rail section 300 and connected to the rail section 300 by a user. The guide 320 includes a base 322 that mounts to the rail section 300 and side members 324, 326 connected to the base 322. In one form, the guide 320 includes a pivotal connection, such as a living hinge 328, connecting each of the side members 324, 326 to the base 322.

Figure 22:
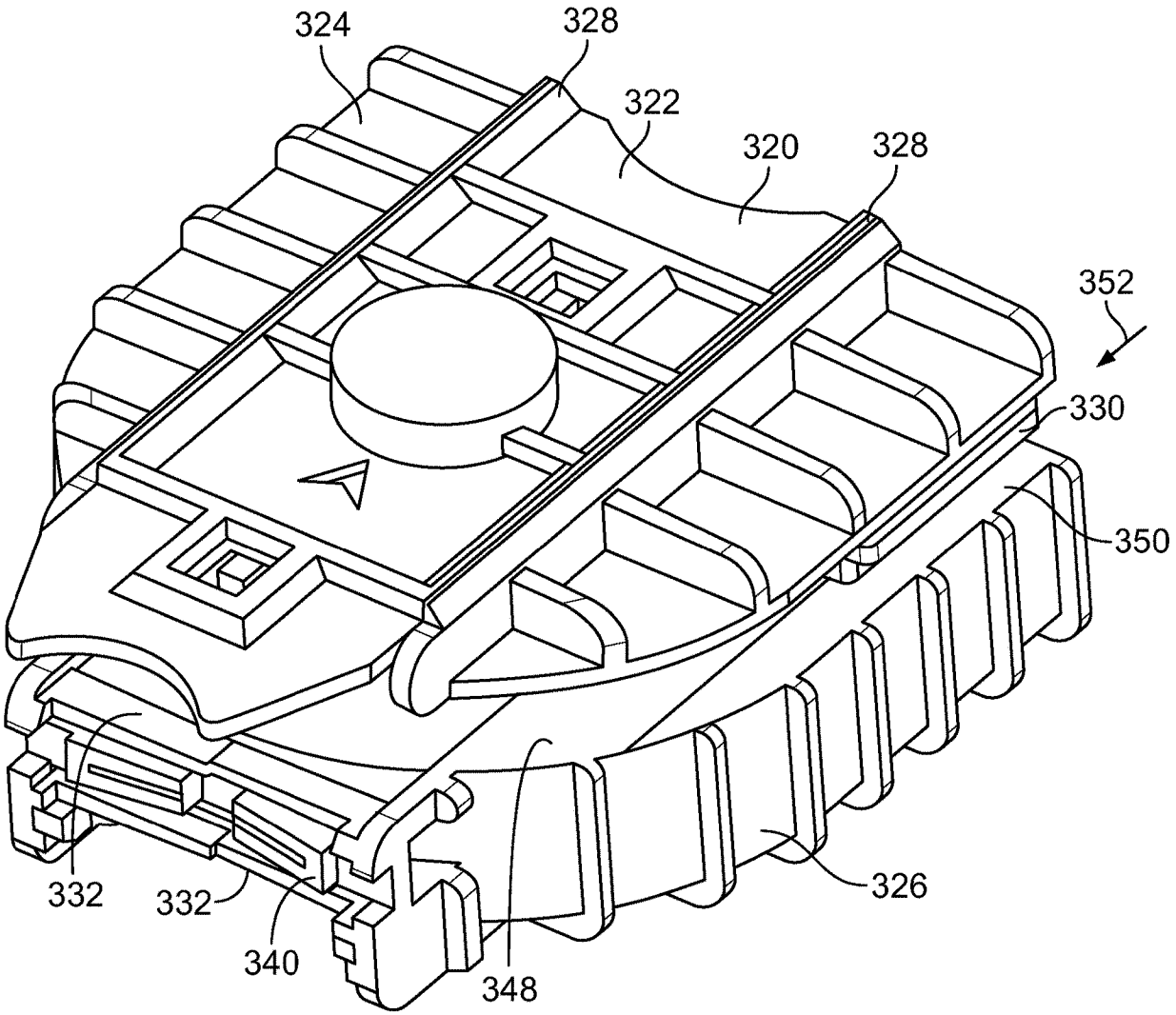
FIG. 22 is a perspective view similar to FIG. 21 showing the side members pivoted down to a second, operating position.
Figure 24:
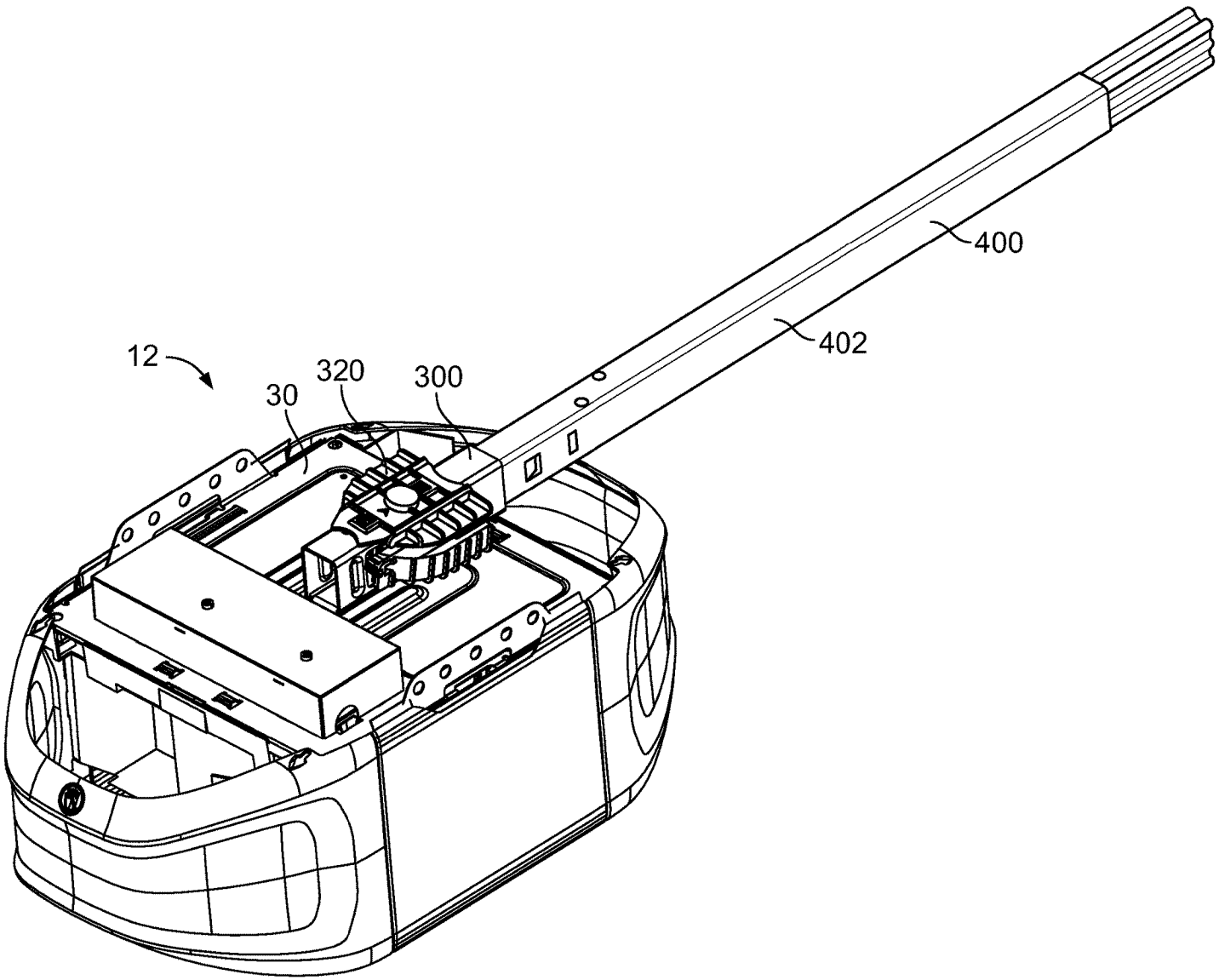
FIG. 24 is a bottom perspective view of the head unit of FIG. 2 showing the side members of the guide in the second, operating position.

The side members 324, 326 are movable from a first, assembly position (see FIGS. 3 and 20) to a second, operating position (see FIGS. 22 and 24). When a belt is used with the head unit 12, the user moves the side members 324, 326 from the first to the second position after the belt has been positioned around the drive pinion 304. When a chain is used with the head unit 12, the user moves the side members 324, 426 from the first to the second position before the chain is positioned around the drive pinion 304.

With reference to FIG. 20, each side member 324, 326 includes a chain separating member 329 and a belt backing member 332. The chain separating members 329 separate lengths of the chain as the chain approaches or moves away from drive pinion 304. The chain separating members 329 include chain shifting members 330 for shifting the belt away from the outer surface 319 of the rail section 330 as the chain moves toward the drive pinion 304. The chain separating members 329 operate to limit noise caused by contact between the chain and the rail section 330. The belt backing member 332 resists the belt from disengaging from the drive pulley 306 and slipping relative to the drive pulley 306.

Figure 21:
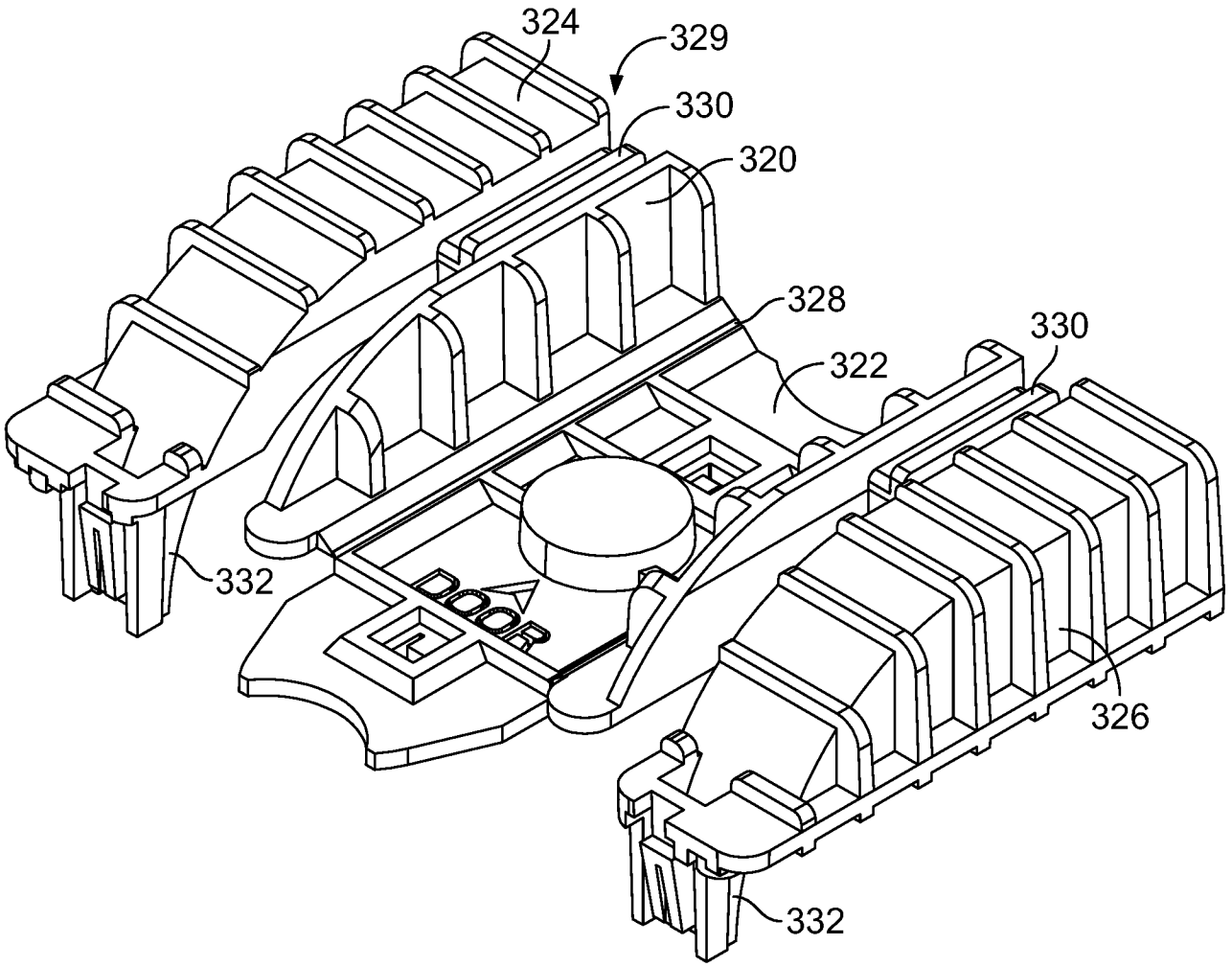
FIG. 21 is a perspective view of the guide of FIG. 20 showing side members of the guide in a first, assembly position.

With reference to FIGS. 21 and 22, the belt backing members 332 of the side members 324, 326 depend downwardly with the side members 324, 326 in the first position. Pivoting the side members 324, 326 to the second, operating position swings the belt backing members 332 into the openings 317 of the rail section 300. The belt backing members 332 may include barbs 340 for engaging the rail section 300.

Figure 23:
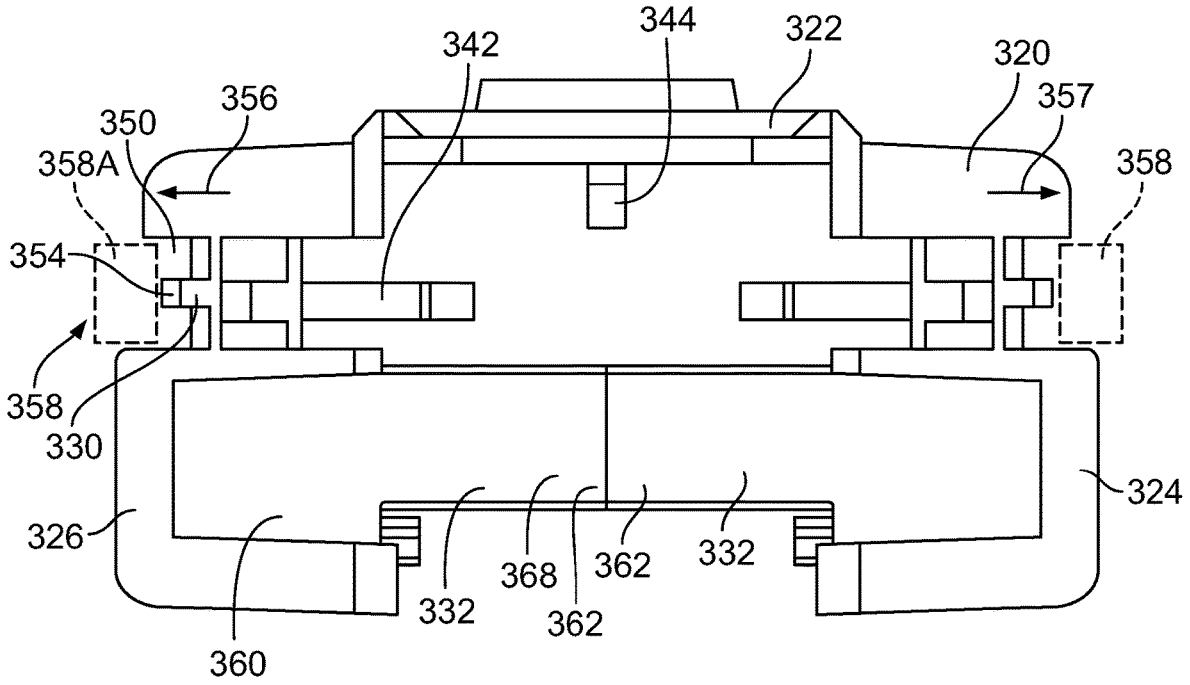
FIG. 23 is an elevational view of the guide of FIG. 21 showing a belt-backing surface of the guide that resist a belt from slipping off of a drive pulley of the rotatable drive member.

With reference to FIG. 23, the side members 324, 326 may each include another barb 342 for engaging openings of the rail section 300 and resisting movement of the side members 324, 326 away from the second, operating position. Further, the base 322 may include one or more barbs 344 for engaging the rail section 300 and securing the base 322 to the rail section bottom wall 310.

With reference to FIGS. 22 and 23, the guide 320 has a chain-receiving opening 348 that opens to the drive pinion 304. The chain separating member 329 of each side member 324, 326 includes a channel 350 that opens to the chain-receiving opening 348. The chain may travel in direction 352 along the channels 350, into the openings 317 of the rail section 300, and onto the drive pinion 304. As shown in FIG. 23, the chain shifting members 330 are in the channels 350 and include outer surfaces 354 for contacting a chain 358 and separating the chain 358 by shifting portions 358A, 358B of the chain 358 apart in directions 356, 357.

With reference to FIG. 23, the guide 320 includes a band-receiving cavity 360 that extends about the drive pulley 306. The belt-backing members 332 each have an end 362 that abuts the end 362 of the other belt-backing member 332 when the side members 324, 326 are in the second, operating position. The belt-backing members 332 include curved belt-facing surfaces 368 that together form an arcuate shape around the drive pulley 306.

As shown in FIG. 24, the rail section 300 receives a rail section 400 of the rail 13. The rail 13 is formed by a plurality of rail sections 400 connected to the rail section 300. The rail section 400 of FIG. 24 has an outer surface 402 along which the belt or chain is driven along by the rotatable drive member 302.

Figure 25:
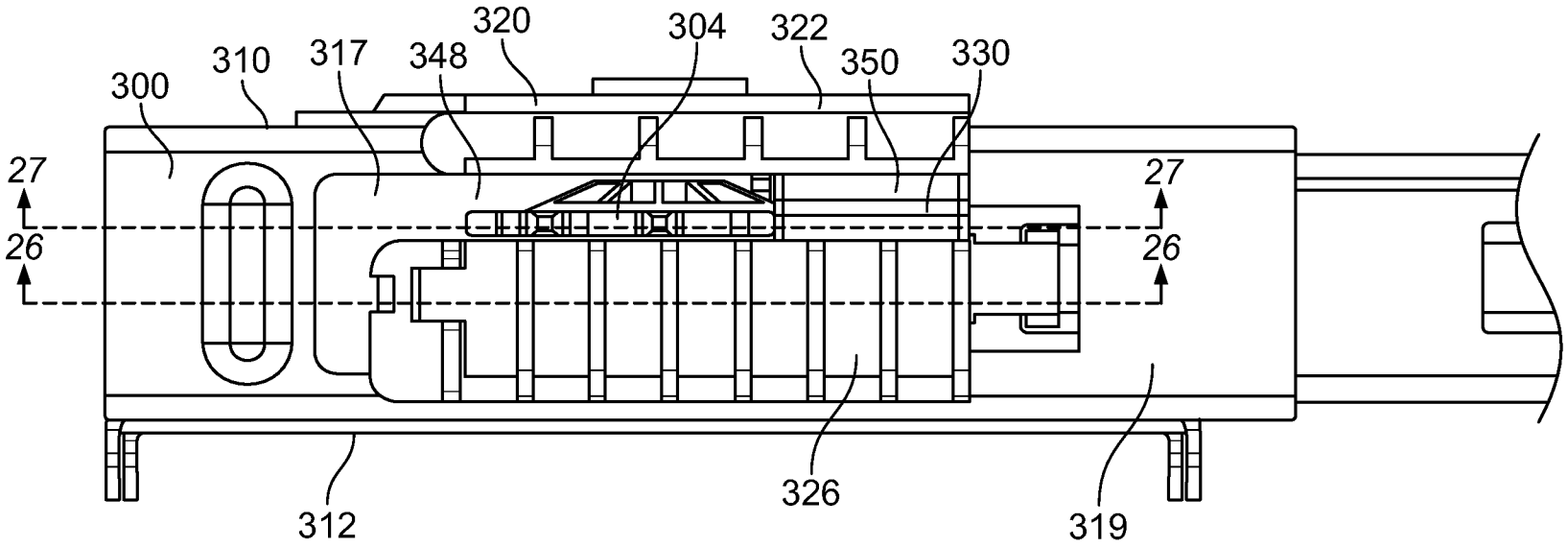
FIG. 25 is a side elevational view of the rail section and the guide of FIG. 24 showing an opening in the side member of the guide to permit a chain to engage a drive pinion of the rotatable drive member.

With reference to FIG. 25, the channels 350 of the side members 324, 326 are aligned with the drive pinion 304 to direct the chain 358 onto the drive pinion 304 and receive the chain 358 from the drive pinion 304. The channels 350 open to the chain-receiving opening 348 of the guide 320 and the rail section opening 317 to permit the chain 358 to travel smoothly through the channels 350 and onto or off of the drive pinion 304.

Figure 26:
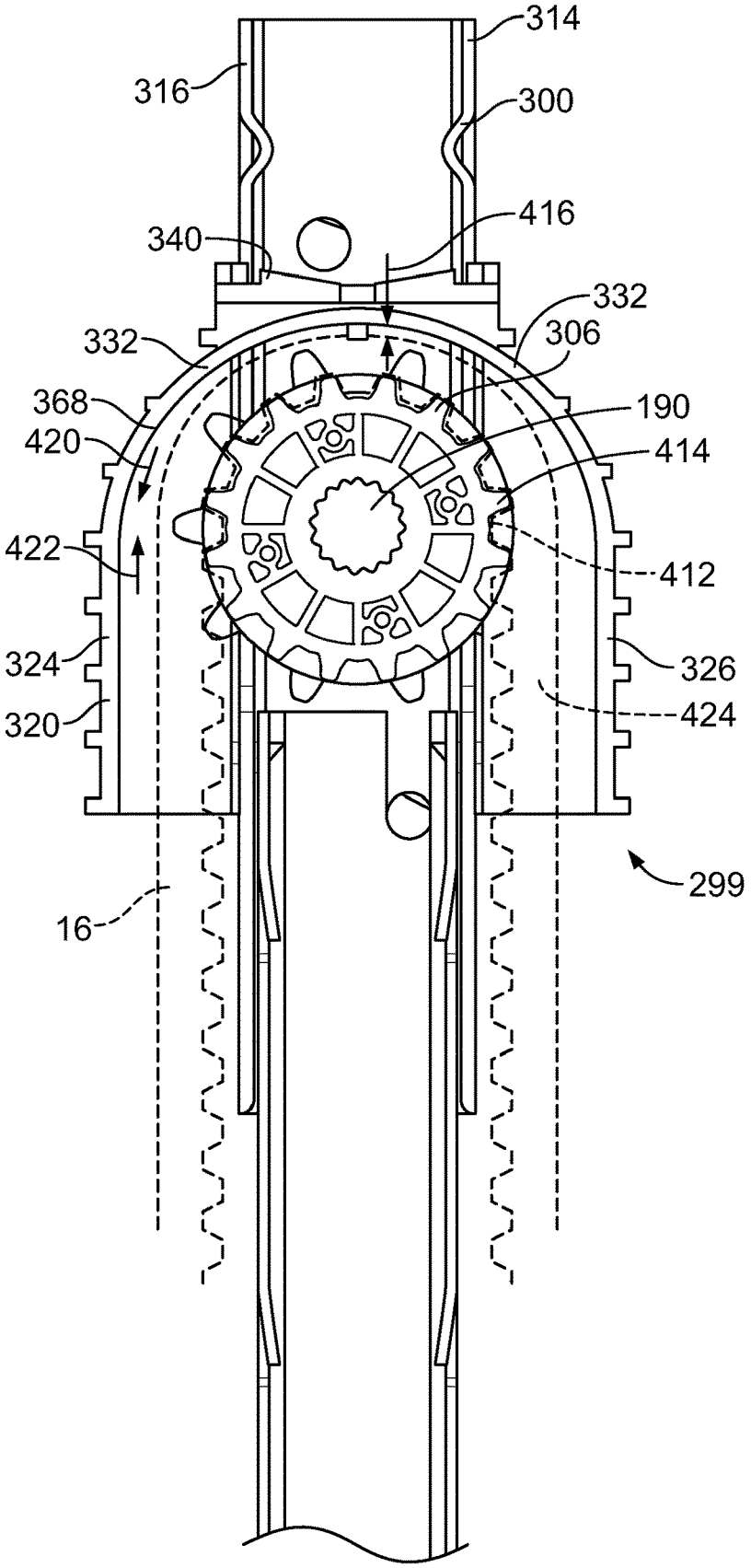
FIG. 26 is a cross-sectional view taken across line 26-26 in FIG. 25 showing the curved belt-backing surface of the guide that extends around the drive pulley.

With reference to FIG. 26, the drive assembly 299 is shown utilizing the belt 16. The belt 16 has teeth 412 engaged with teeth 414 of the drive pulley 306. The belt-facing surface 368 of the belt-backing members 332 extends around the belt 16 and is spaced therefrom by a distance 416 to provide clearance for the belt 16 during normal operation. When the drive pulley 306 suddenly reverses in direction 420, 422 and the belt 16 is under significant tension, the drive pulley teeth 414 may turn relative to the belt teeth 412 and cam the belt teeth 412 out of engagement with the drive pulley teeth 414. This may shift a body 424 of the belt 16 radially outward from the drive pulley 306 which decreases the distance between the belt 16 and the belt-facing surface 368. If the belt 16 shifts radially outward a predetermined distance, the belt 16 contacts the belt-facing surface 368 of the belt-backing members 332. The belt-backing members 332 resist further radially outward movement of the belt 16 and keep the belt teeth 412 sufficiently engaged with the drive pulley teeth 414 so that the belt 16 does not slip relative to the drive pulley 306. The belt-backing members 332 may be positioned to keep the belt teeth 414 from shifting radially outward beyond a predetermined distance. For example, the distance 416 may be ⅓ of the height of the belt teeth 412.

Figure 27:
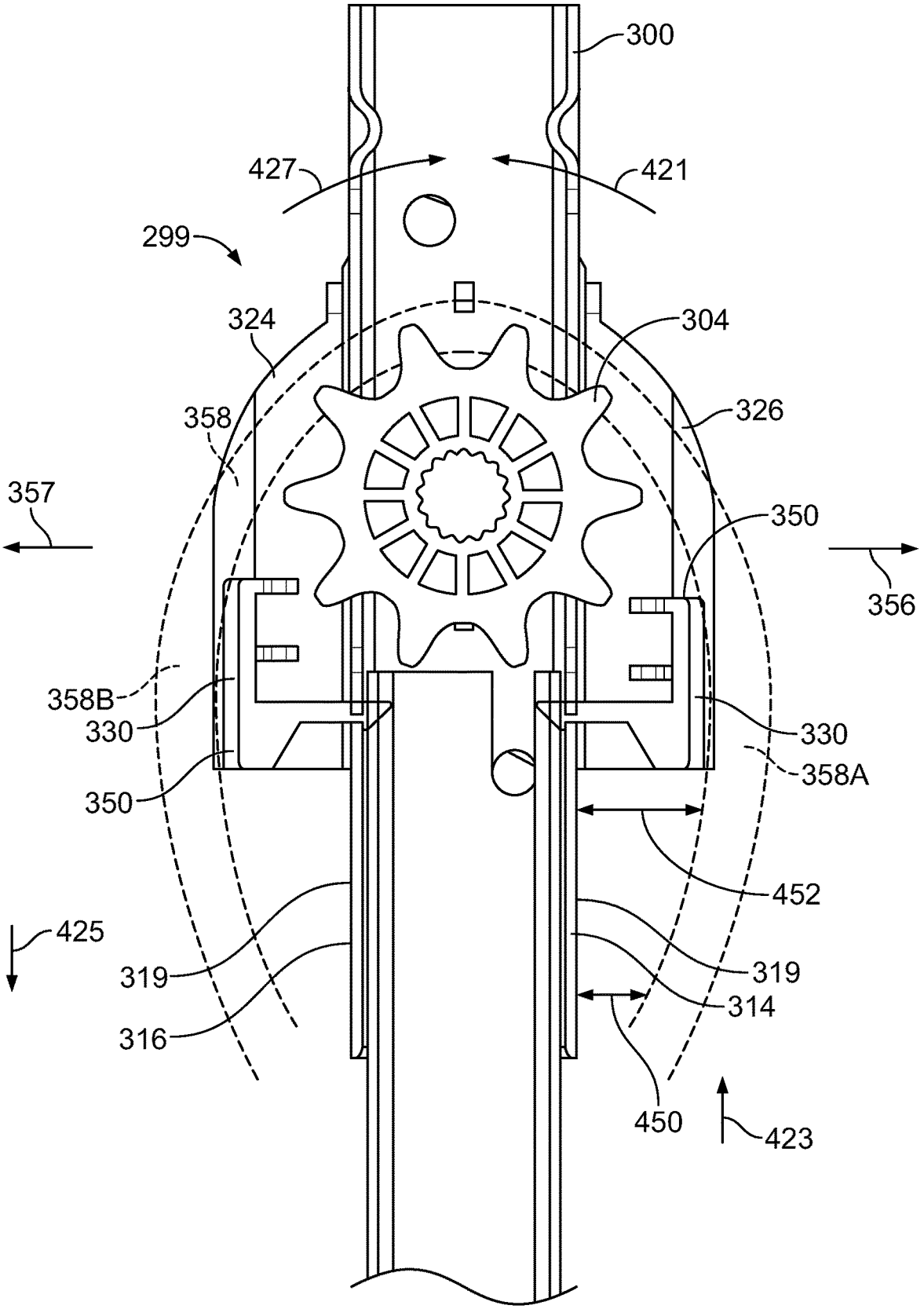
FIG. 27 is a cross-sectional view taken across line 27-27 in FIG. 25 showing belt separating members of the guide shifting the chain away from the rail near the drive pinion.

With reference to FIG. 27, the drive assembly 299 is shown utilizing the chain 358. The chain 358 extends through the channels 350 of the side members 324, 326. When the drive pinion 304 turns in direction 421, the chain shifting member 330 shifts the chain portion 358A in outward in direction 356 as the chain portion 358A travels in direction 423 onto the drive pinion 304. The chain shifting member 330 of the side member 326 shifts the chain portion 358A outward in direction 356 to increase the distance between the chain portion 358A and the rail section side wall 314 from a distance 450 to a distance 452. This distance 452 allows the guide 320 to direct the chain portion 358 along a somewhat tangential path onto the drive pinion 304. Further, the presence of the chain shifting member 330 inhibits noise caused by contact between the chain 358 and the rail section 330. As the drive pinion 304 turns in direction 421, the chain portion 358B travels in direction 425 into the channel 350 of the side member 324, along the chain shifting member 330, out of the channel 350, and inwardly toward the rail section side wall 316. When the drive pinion 304 turns in an opposite direction 427, the chain shifting member 330 of the side member 324 shifts the chain portion 358B outward in direction 352 and the chain shifting member 330 of the side member 326 directs the chain portion 358A toward the rail section side wall 314. In this manner, the guide 320 provides the dual operations of maintaining the belt 16 in engagement with the drive pulley 306 if the belt 16 is used with the head unit 12 and separates the chain portions 358A, 358B if the chain 358 is used with the head unit 12.

Figure 28A:
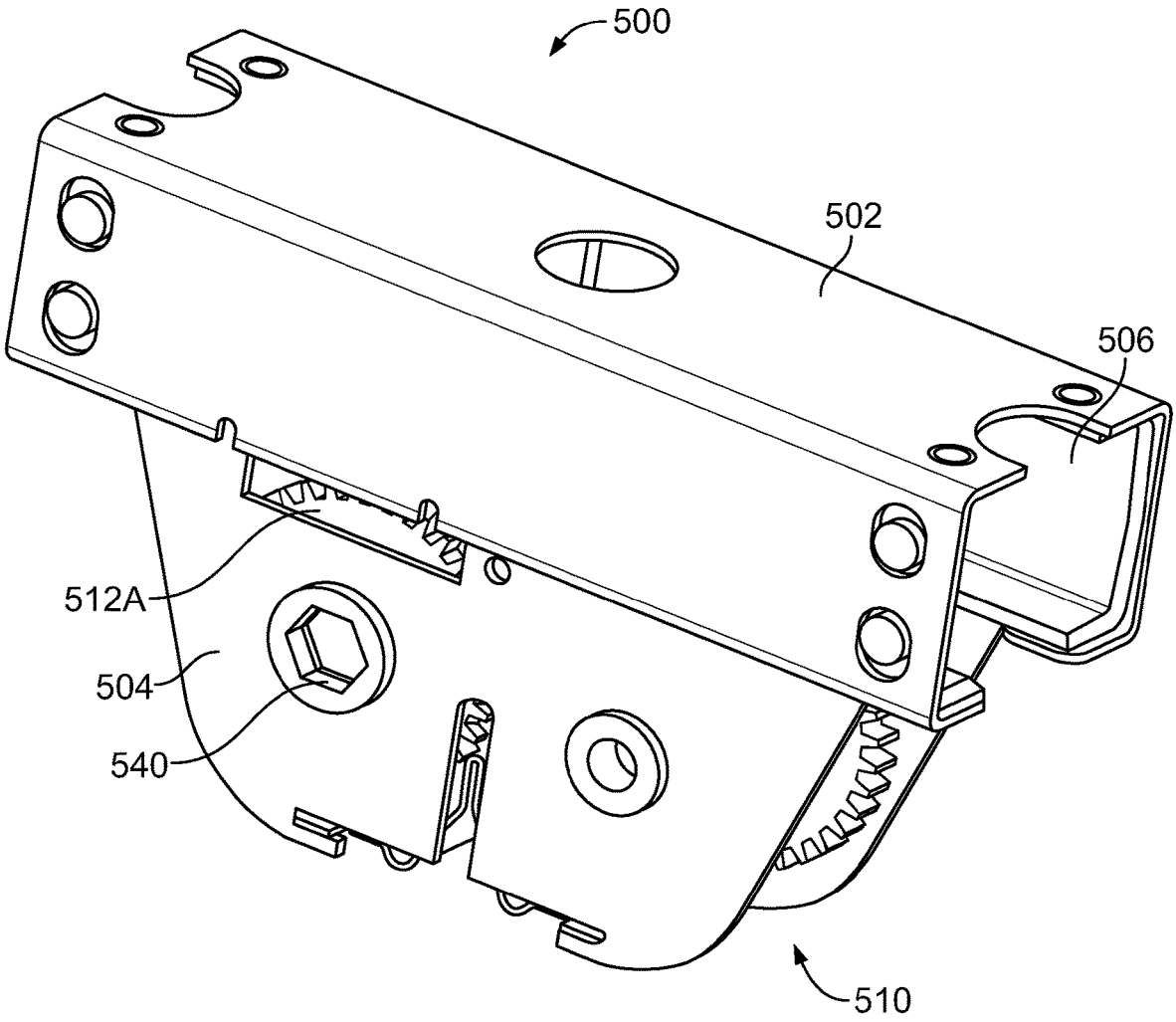
FIG. 28A is a perspective view of an inner trolley assembly for use with the head unit of FIG. 2 showing a sleeve of the inner trolley assembly that receives the rail.

With reference to FIG. 28A, an inner trolley assembly 500 of the trolley 14 is provided. The inner trolley assembly 500 includes a rail portion, such as a sleeve 502, and a body 504 extending outward from the sleeve 502. The sleeve 502 includes pads 506 that are configured to slide along outer surfaces of the rail 12 and may be made of low-friction material, such as plastic, and may include rollers. The inner trolley assembly 500 includes a belt securement mechanism 510 that allows a user to quickly and easily connect ends of the belt 16 to the inner trolley assembly 500 if the belt 16 is to be used with the head unit 12. If a chain is to be used, a chain-receiving inner trolley assembly is used.

Figure 28B:
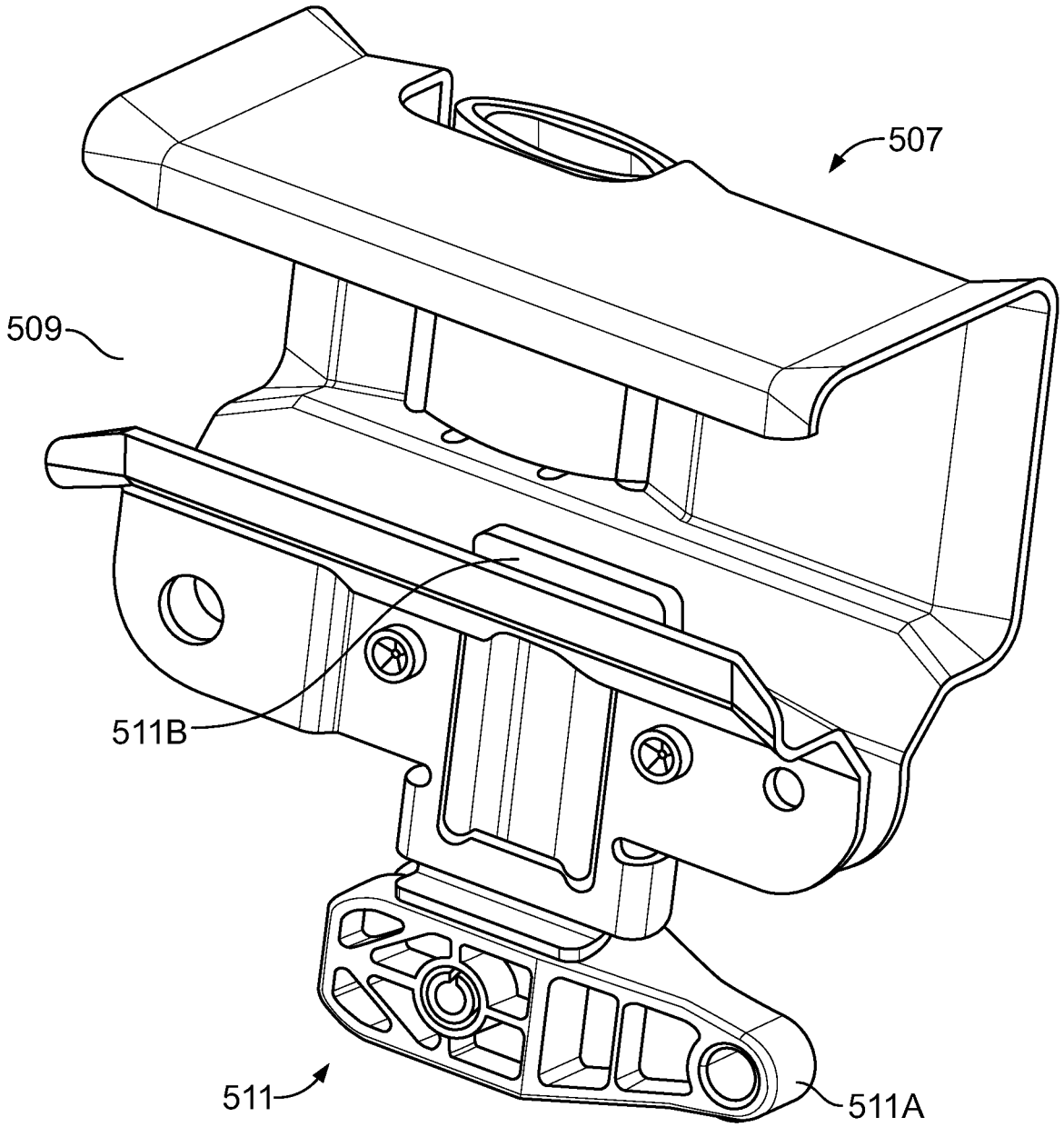
FIG. 28B is a perspective view of an outer trolley assembly that receives the inner trolley assembly of FIG. 28A.

In FIG. 28B, an outer trolley assembly 507 is provided that receives the inner trolley assembly 500 such that the body 504 of the inner trolley assembly 500 extends outward from a slot 509 of the outer trolley assembly 507. The outer trolley assembly 507 includes the release mechanism 511 having an arm 511A to which a rope and handle are connected. The release mechanism 511 includes a latch 511B that engages the inner and outer trolley assemblies 500, 507 together. When a user pulls on the rope and handle connected to the arm 511A, the release mechanism 511 shifts the latch 511B from an engaged position to a disengaged position. With the latch 511B in the disengaged position, the inner trolley assembly 500 may slide out of the outer trolley assembly 507.

Figure 29:
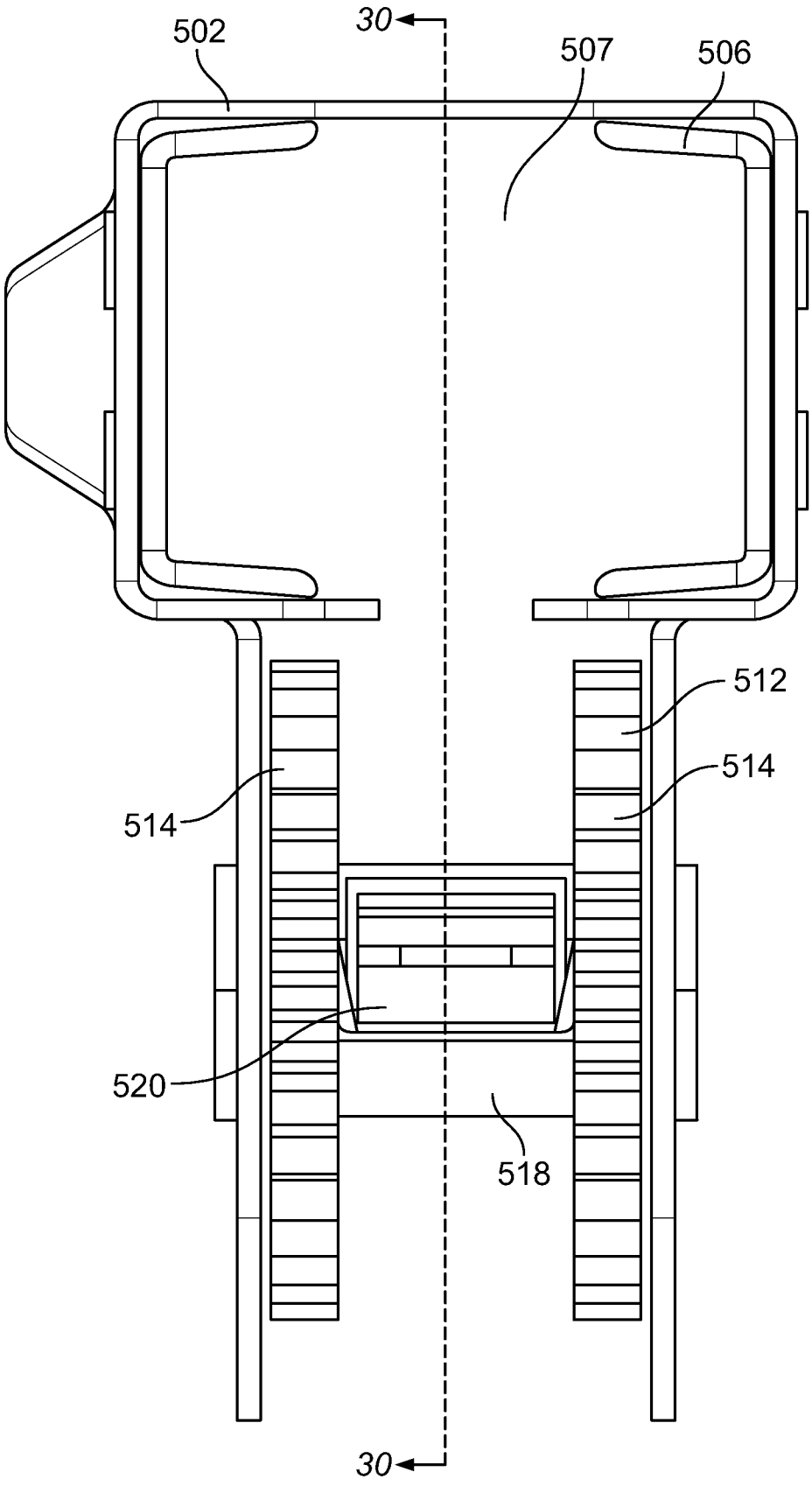
FIG. 29 is an elevational view of the inner trolley assembly of FIG. 28 showing a rotary tensioner having gear teeth and a drum portion onto which a belt may be wound.
Figure 30:
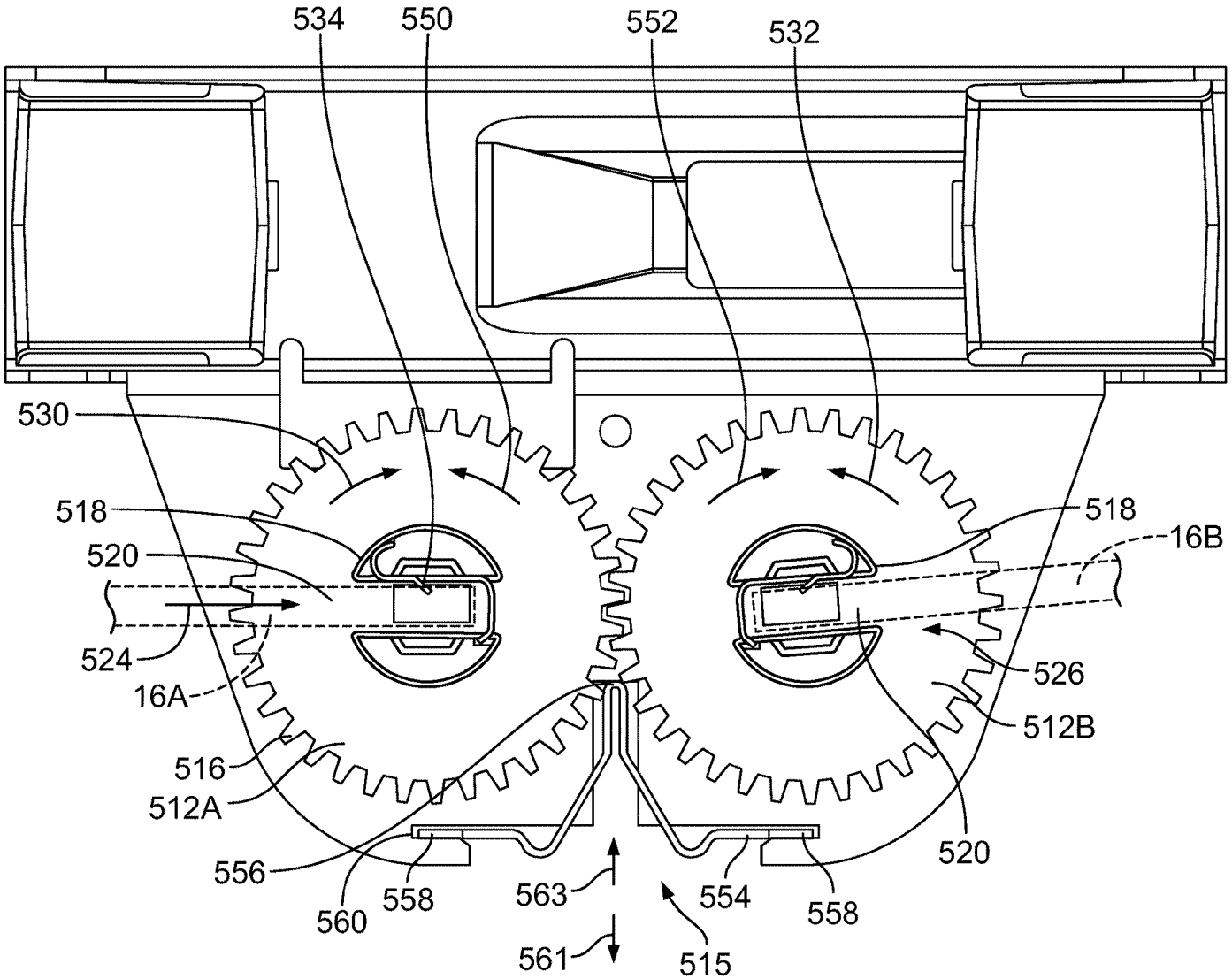
FIG. 30 is a cross-sectional view taken across line 30-30 in FIG. 29 showing a resilient member that is drawn into the mesh between teeth of the rotary tensioners as the rotary tensioners turn in the payout direction to resist further turning of the rotary tensioners in the payout direction and loosening of the belt.

With reference to FIGS. 29 and 30, the belt securement mechanism 510 includes one or more rotary tensioners 512 rotatably mounted to the body 504. In one form, the one or more rotary tensioners 512 includes two rotary tensioners 512A, 512B each having one or more gear portions 514 with teeth 516 and a drum portion 518 connecting the gear portions 514. Each drum portion 518 includes a slot 520 that receives one end of the belt 16. To connect end portions 16A, 16B of the belt 16 to the inner trolley assembly 500, a user advances the end portions 16A, 16B of the belt 16 in directions 524, 526 into the slots 520 of each of the rotary tensioners 512. The user then turns the rotary tensioner 512A in tensioning direction 530 and turns the rotary tensioner 512B in tensioning direction 532. The end portions 16A, 16B of the belt 16 are each held in the respective slot 520 by an anchor member, such as a tooth 534, which permits the end portions 16A, 16B to be inserted into the slots 520 and resist removal of the belt end portions 16A, 16B from the slots 520. As the user turns the rotary tensioners 512A, 512 in tensioning directions 530, 532, the end portions 16A, 16B of the belt 16 are wound up onto the drum portions 518 of the rotary tensioners 512A, 512B. The tension in the belt 16 tightly holds the end portions 16A, 16B of the belt 16 on the drum portions 518 as the rotary tensioners 512A, 512B are turned in the tensioning directions 530, 532.

In one form, the rotary tensioner 512A includes a tool receiving portion, such as a hex socket 540 (see FIG. 28A) that receives a hex driver. The user applies a torque in direction 530 to the rotary tensioner 512A using the hex driver engaged in the hex socket 540. The teeth 516 of the rotary tensioners 512A, 512B are intermeshed so that turning the rotary tensioner 512A in tensioning direction 530 causes turning of the rotary tensioner 512B in tensioning direction 532. Thus, a user need only turn one of the rotary tensioners 512 to cause turning of both rotary tensioners 512A, 512B and wind the belt end portions 16A, 16B onto the drum portions 518 of the rotary tensioners 512A, 512B.

The inner trolley assembly 500 may also include a ratchet mechanism 515 to resist turning of the rotary tensioners 512A, 512B in release directions 550, 552 and loosening of the belt 16. In one form, the ratchet mechanism 515 includes a resilient member, such as spring 554, having a pawl portion 556 near the teeth 516 and end portions 558 received in slots 560 of the body 504. The end portions 558 may be held in place in the slots 560 by, for example, an interference fit. In one form, each of the gear portions 514 and the spring 554 are made from metallic material, such as steel or aluminum. As the user turns the rotary tensioners 512A, 512B in the tensioning directions 530, 532, the teeth 516 contact the pawl portion 556 and shift the pawl portion 556 in direction 561 out of the way of the teeth 516. When the user stops turning the rotary tensioners 512A, 512B in the tensioning directions 530, 532, the tension in the belt 16 urges the rotary tensioners 512A, 512B in release directions 550, 552. The teeth 516 contact the pawl portion 556 and draw the pawl portion 556 in direction 563 into the mesh between the teeth 516 of the rotary tensioners 512A, 512B. The presence of the spring pawl portion 556 in the mesh of the teeth 516 of the rotary tensioners 512A, 512B prevents the rotary tensioners 512A, 512B from turning farther in the released directions 550, 552. In one form, the teeth 516 deform spring pawl portion 556 therebetween which locks rotary tensioners 512A, 512B in position relative to each other.

Figure 31:
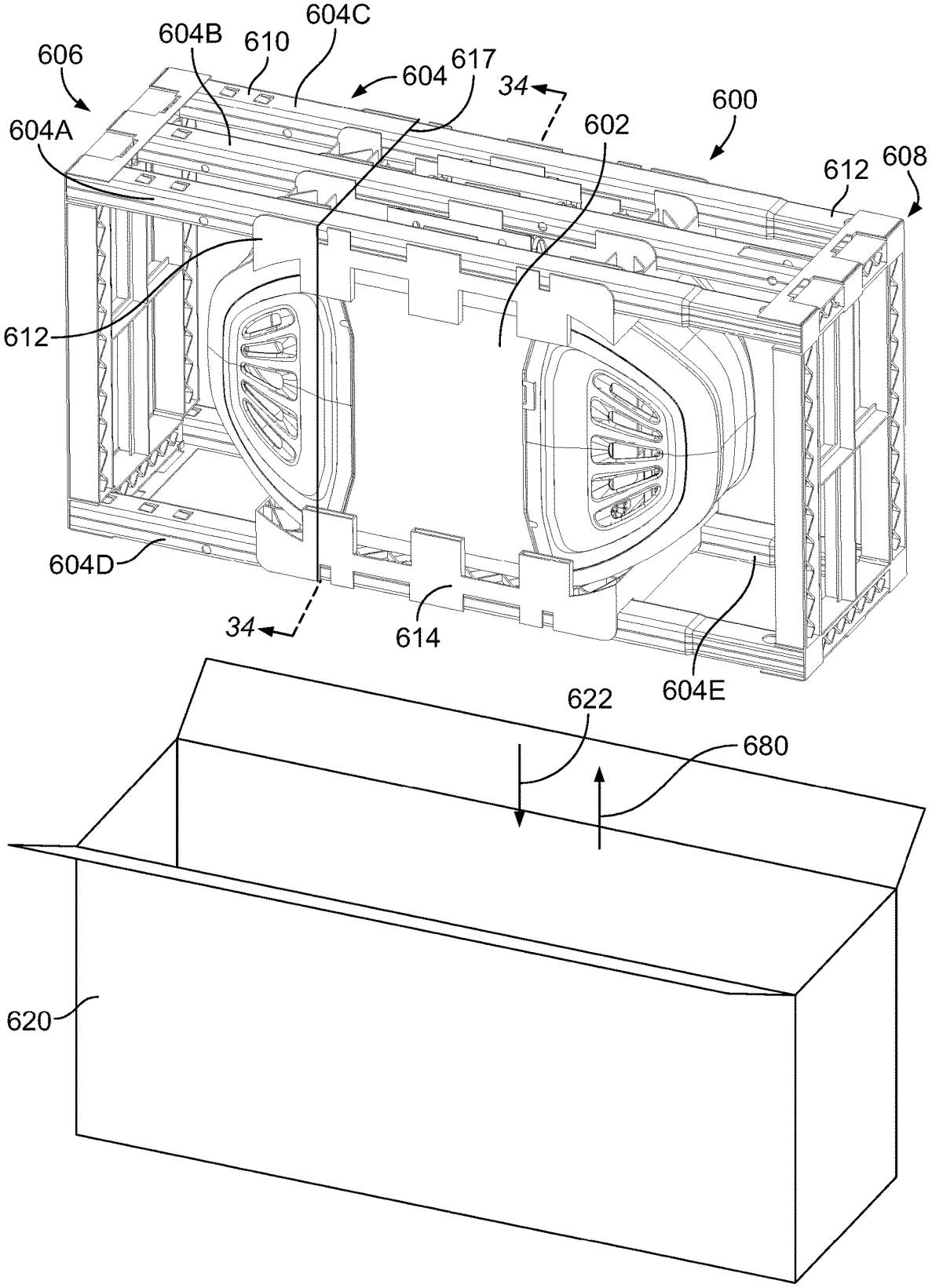
FIG. 31 is a perspective view of a movable barrier operator system being inserted into a box.

With reference to FIG. 31, a movable barrier operator system 600 is provided that includes a head unit 602 and rail sections 604. The movable barrier operator system 600 utilizes the strength of the rail sections 604, which may be made of metallic material such as steel, to protect the head unit 602 during transport. The movable barrier operator system 600 includes at least one support, such as end supports 606, 608 that each receive an end portion 610, 612 of the rail sections 604. The end supports 606, 608 may be made of, for example, a plastic material or a paper material (e.g. cardboard) that can absorb impacts as well as maintain the arrangement of the rail sections 604 around the head unit 602. In one form, the end supports 606, 608 include one or more compartments for receiving components of the movable barrier operator system 600. For example, the end supports 606, 608 may include compartments for fasteners, tools, and other components for installing the system 600.

Figure 32:
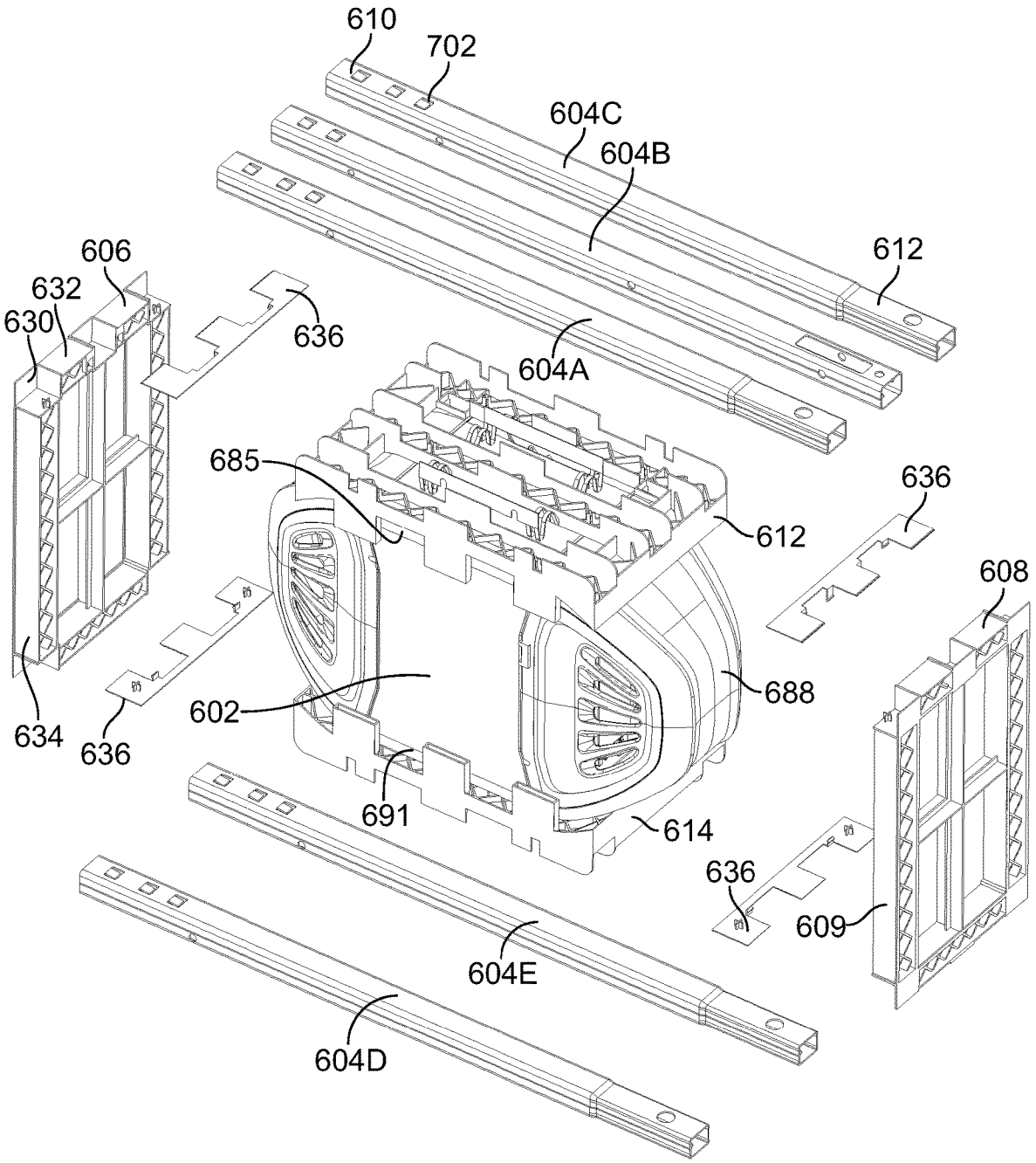
FIG. 32 is an exploded view of the movable barrier operator system of FIG. 31 showing a head unit of the system, cradles on opposite sides of the head unit, and rail sections that are received in channels of the cradles.
Figure 33:
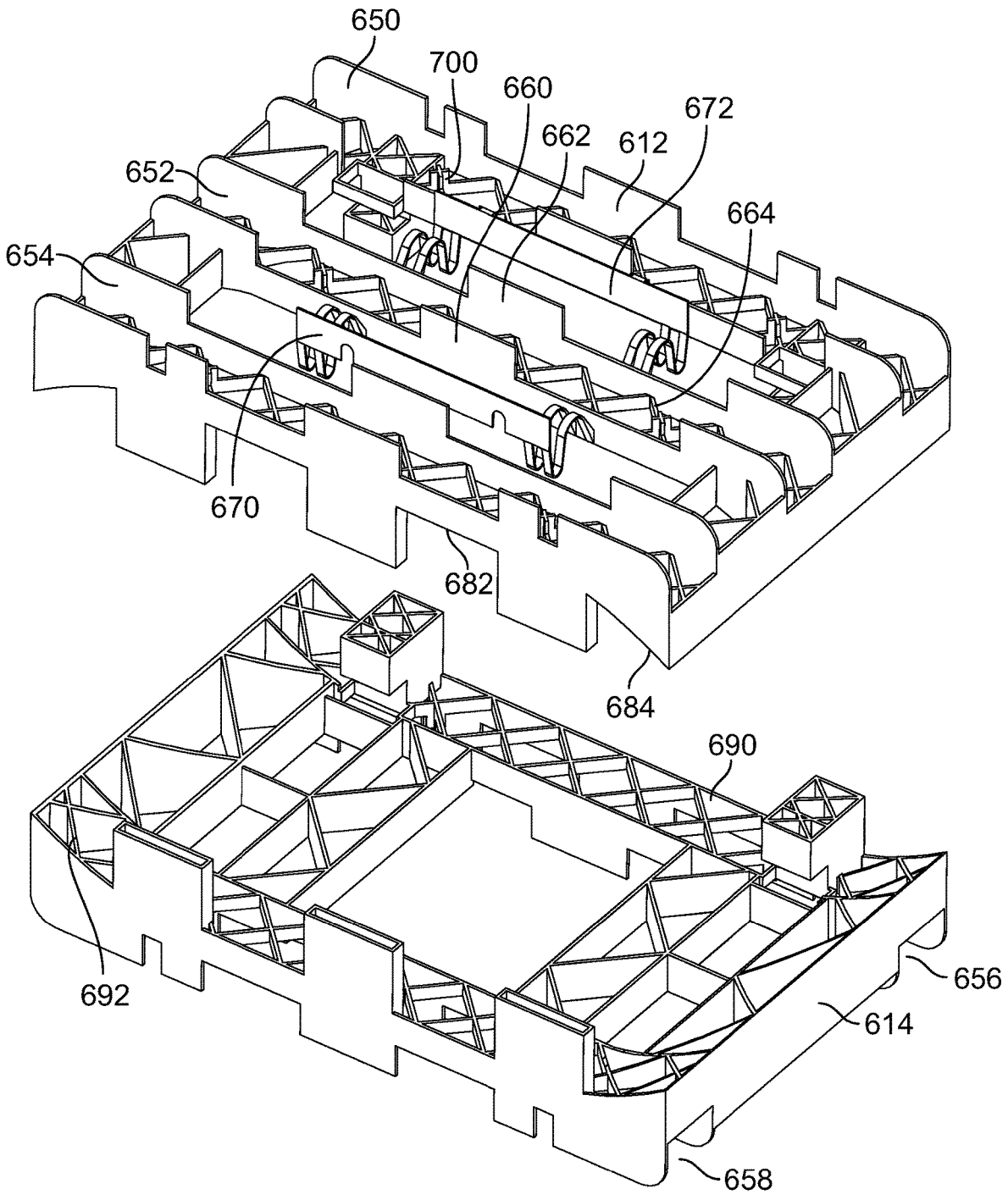
FIG. 33 is a perspective view of the cradles of FIG. 32 showing channels of the cradles and surfaces of the cradles that engage the head unit.
Figure 34:
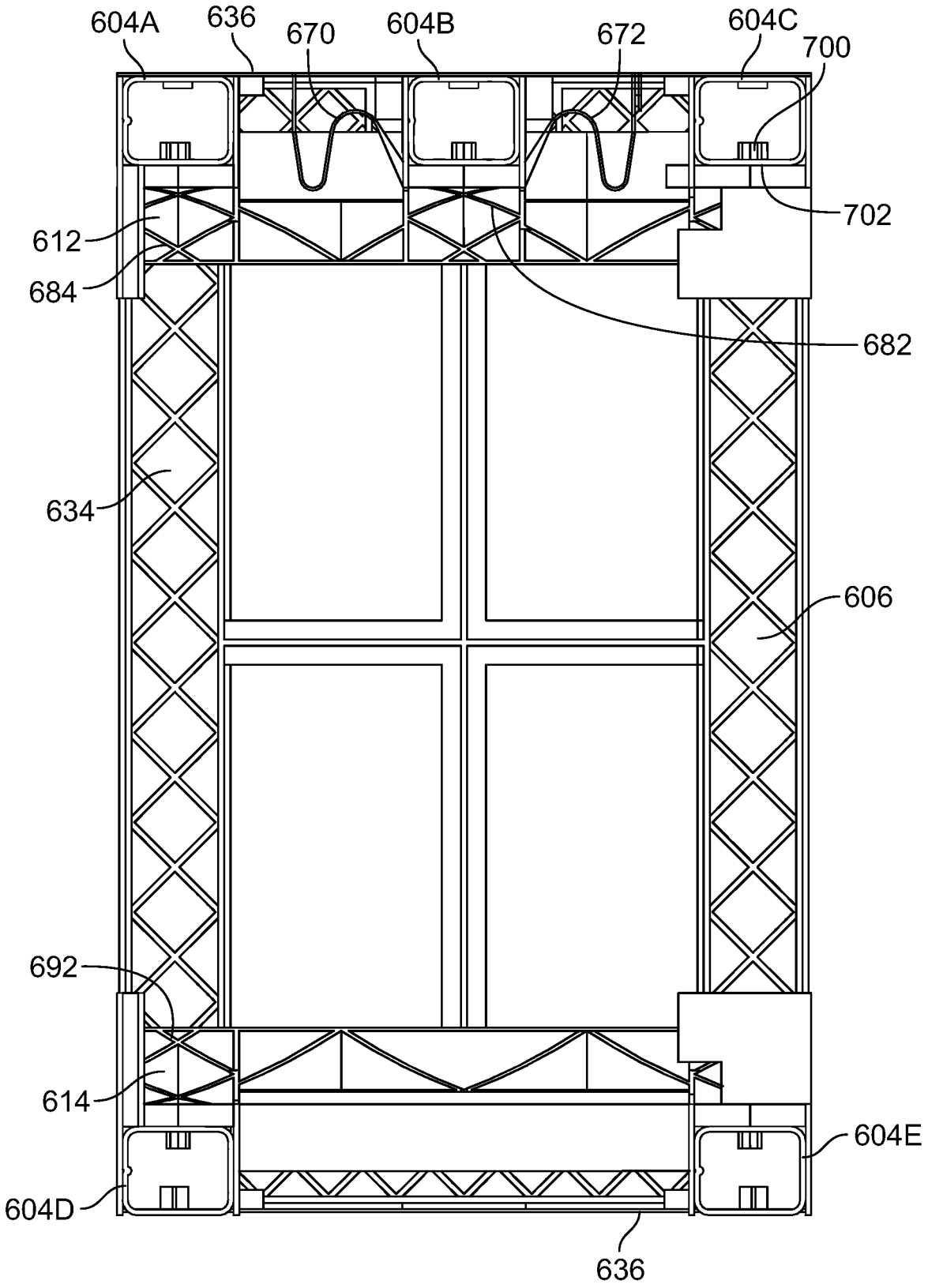
FIG. 34 is a cross-sectional view taken across line 34-34 in FIG. 31 with the head unit removed to show the arrangement of the rail sections, the cradles, and one of the end supports.

The rail sections 604 may include five rail sections 604A-604E. The rail sections 604A, 604B, 604C extend along one side of the head unit 602 while the rail sections 604D, 604E extend along the opposite side of the head unit 602. The movable barrier operator system 600 further includes an upper cradle 612 and a lower cradle 614. The upper and lower cradles 612, 614 form a complementary engagement with the exterior of the head unit 602 and securely hold the head unit 602 between the rail sections 604. With reference to FIGS. 33 and 34, the upper and lower cradles 612, 614 may include posts 700 that extend through openings 702 of the rail sections 604. The engagement of the posts 700 in the openings 702 resists longitudinal movement of the upper and lower cradles 612, 614 and head unit 12 held therebetween along the rail sections 604. As shown in FIG. 32, the end supports 606, 608 may also include posts 704 arranged to extend into openings of the end portions 610, 612 of the rail sections 604 and resist disengagement of the end portions 610, 612 from the end supports 606, 608.

The movable barrier operator system 600 may be readily positioned into a container, such as a box 620, in direction 622. The movable barrier operator system 600 provides an organized and efficient way to transport the system 600 because additional foam and cardboard inserts may not be required to provide rigidity to the box 620. Additionally, the system 600 may be withdrawn from the box 620 as a complete assembly for installation rather than having to individually remove the components from the box 620.

With reference to FIG. 32, the end supports 606, 608 include bodies 609 having receiving portions, such as recesses 630, for the end portions 610, 612 of the rail sections 604. The end supports 606, 608 include girder portions 632 for supporting the rail sections 604 and column portions 634 that separate the girder portions 632. The column portions 634 may be configured to be energy-absorbent to absorb impacts, such as dropping of the box 620 and the movable barrier operator system 600 therein. For example, the column portions 634 may deform to absorb the energy from the impact of the box 620 against a surface. The end supports 606 may also include covers 636 connected to the bodies 609 to hold the rail section end portions 610, 612 in the recesses 630. One or more straps 617 may be used to encircle the rail sections 604, cradles 612, 614, and head unit 602 and hold the assembly of the rail sections 604, cradles 612, 614, and head unit 602 in a tightly bundled manner. Further, the rail section end portions 610, 612 hold the end supports 606, 608 in position between the rail section end portions 610, 612.

With reference to FIG. 33, the upper cradle 612 includes channels 650, 652, 654 that receive, respectively, rail sections 604C, 604B, 604A. The lower cradle 614 includes channels 656, 658 that receive, respectively, rail sections 604E, 604D. To constrain and support the rail sections 604 within the upper and lower cradles 612, 614, the channels include walls 660, 662 and floors 664. The channels 650, 652, 654, 656, 658 may have a generally U-shape. The walls 660, 662 of the channel 652 may be provided with handles 670, 672. The handles extend laterally away from the walls 660, 662. To remove the movable barrier operator system 600 from the box 620, the user grasps one or both of the handles 670, 672 and pulls upward on the upper cradle 612 to withdraw the movable barrier operator system 600 in direction 680 from within the box 620 (see FIG. 31).

The upper and lower cradles 612, 614 may have surfaces that are complimentary to the sides of the head unit 602. For example, the upper cradle 612 may have a cradle surface 682 that is relatively flat for contacting a relatively flat side surface 685 of the head unit 602. The upper cradle 612 also includes curved portions 684 that extend along and support tapered lens covers 688 of the head unit 602 (see FIG. 32). The lower cradle 614 likewise includes a substantially flat cradle surface 690 for supporting a relatively flat side surface 691 of the head unit 602 and curved portions 692 extending along and supporting the tapered lens covers 688. The cradles 612, 614 thereby form a mating fit with the sides of the head unit 602 to hold the head unit 602 in position along the rail sections 604. The cradles 612, 614 may include structures for maintaining the head unit 602 in position, such as posts that extend into recesses of the head unit 12.

With reference to FIG. 34, a cross-section of the movable barrier operator system 600 is shown with the head unit 602 is removed. The rail sections 604A, 604B, 604C, 604D, 604E are arranged to form a protective cage around the head unit 602. Further, FIG. 34 shows the curved portions 684, 692 of the cradles 612, 614 converging toward each other to compliment the tapering profile of one of the lens covers 688.

Those skilled in the art will recognize that a wide variety of modifications, alterations, and combinations can be made with respect to the above described embodiments without departing from the scope of the invention as set forth in the claims, and that such modifications, alterations, and combinations are to be viewed as being within the ambit of the inventive concept.

What is claimed is:

1. A movable barrier operator system comprising:
- a rail;
- a trolley configured to be connected to a movable barrier and moved along the rail to cause movement of the movable barrier;
- a head unit adapted to utilize either a belt or a chain to drive the trolley;
- a rotatable drive member of the head unit configured to engage and drive either of the belt and the chain; and
- a guide associated with the rail and having chain separating members adapted to spread portions of the chain apart and at least one belt backing member adapted to keep the belt engaged with the rotatable drive member.

2. The movable barrier operator system of claim 1 wherein the rotatable drive member includes a drive pinion aligned along the rail with the chain separating member for engaging and driving the chain and a drive pulley aligned along the rail with the at least one belt backing member for engaging and driving the belt.

3. The movable barrier operator system of claim 1 wherein the chain separating members include a pair of channels at opposite sides of the rail.

4. The movable barrier operator system of claim 1 wherein the at least one belt backing member includes at least one curved surface extending about the rotatable drive member.

5. The movable barrier operator system of claim 1 wherein the rail includes at least one opening and the at least one belt backing member extends into the at least one opening.

6. The movable barrier operator system of claim 1 wherein the chain separating members includes a chain separating member at opposite sides of the rail and the at least one belt backing member includes a pair of belt backing members at opposite sides of the rail.

7. The movable barrier operator system of claim 1 wherein the guide is assembled with the rail.

8. A guide for guiding the movement of either a belt or a chain driven along a rail of a movable barrier operator by a rotatable drive of the movable barrier operator, the guide comprising:
- a base adapted to be secured to the rail;
- at least one chain shifting member configured to shift a chain away from the rail; and
- at least one belt backing member configured to keep the belt engaged with the rotatable drive.

9. The guide of claim 8 wherein the at least one chain shifting member and the at least one band backing member are movable relative to the base from an installation position to an operating position.

10. The guide of claim 8 further comprising at least one side member connected to the base having a surface for contacting a first side of the rail and including the at least one chain shifting member and the at least one band backing member.

11. The guide of claim 10 wherein connection between the at least one side member and the base is flexible and permits the at least one side member to be pivoted relative to the base.

12. The guide of claim 8 wherein the at least one chain shifting member includes a pair of chain shifting members spaced apart from each other and the at least one band backing member includes a pair of band backing members.

13. The guide of claim 12 further comprising a pair of side members connected to the base and having surfaces for contacting opposite sides of the rail, the side members each including one of the chain shifting members and one of the band backing members.

14. The guide of claim 13 wherein the side members include channels having the belt shifting members therein and the at least one band backing member includes a curved surface.

15. The guide of claim 8 wherein the base, the at least one chain shifting member, and the at least one band backing member have a unitary, one-piece construction.

* * * * *